US008573171B2

(12) United States Patent
Cecur et al.

(10) Patent No.: US 8,573,171 B2
(45) Date of Patent: Nov. 5, 2013

(54) LOST MOTION VALVE CONTROL APPARATUS

(75) Inventors: Majo Cecur, Rivarolo Canavese (IT); Fabiano Contarin, Riverolo Canavese (IT); Nicola Andrisani, Cumiana (IT); Marco Querio, Castellamonte (IT)

(73) Assignee: Eaton SRL, Turin (IT)

( * ) Notice: Subject to any disclaimer, the term of this patent is extended or adjusted under 35 U.S.C. 154(b) by 0 days.

(21) Appl. No.: 13/389,176

(22) PCT Filed: Aug. 4, 2010

(86) PCT No.: PCT/EP2010/061358

§ 371 (c)(1),
(2), (4) Date: Apr. 11, 2012

(87) PCT Pub. No.: WO2011/015603

PCT Pub. Date: Feb. 10, 2011

(65) Prior Publication Data

US 2012/0186546 A1 Jul. 26, 2012

(30) Foreign Application Priority Data

Aug. 4, 2009 (CN) ..... 200910161581
Aug. 4, 2009 (GB) ..... 0913519.5

(51) Int. Cl.
*F01L 1/14* (2006.01)

(52) U.S. Cl.
USPC ..... 123/90.52; 123/90.16; 123/90.55

(58) Field of Classification Search
USPC ..... 123/90.52, 90.16, 90.55, 90.43, 90.59
See application file for complete search history.

(56) References Cited

U.S. PATENT DOCUMENTS

| | | | | |
|---|---|---|---|---|
| 4,200,081 | A | 4/1980 | Meyer | |
| 5,934,232 | A * | 8/1999 | Greene et al. | 123/90.16 |
| 6,196,175 | B1 | 3/2001 | Church | |
| 2005/0005884 | A1 * | 1/2005 | Geyer et al. | 123/90.16 |

FOREIGN PATENT DOCUMENTS

| | | | |
|---|---|---|---|
| DE | 4338473 | A1 | 4/1995 |
| DE | 19505725 | A1 | 8/1996 |
| DE | 102007008573 | A1 | 8/2008 |

(Continued)

OTHER PUBLICATIONS

European Patent Office; International Search Report and Written Opinion issued in corresponding International Application No. PCT/EP2010/061358. Date of Mailing: Feb. 16, 2011. International Bureau of WIPO; International Preliminary Report on Patentability; Date of Mailing: Feb. 7, 2012.

*Primary Examiner* — Zelalem Eshete
(74) *Attorney, Agent, or Firm* — Dykema Gossett PLLC

(57) ABSTRACT

A valve control device for an internal combustion engine with an engine valve and a camshaft having a cam profile including a first lift profile is disclosed. The device includes a first body and second body. The device is configurable in first and second configurations. When in the first configuration, relative movement between the first and second body, caused when said first lift profile engages a cam engagement surface, inhibits a valve actuating linkage from actuating said engine valve. Embodiments of the device include a means which, when in the second configuration, prevents relative movement between the first and second bodies when the first lift profile engages the cam engagement surface to enable the valve actuating linkage to actuate said engine valve, and when the device is in the second configuration, the means may be arranged so substantially all of the force exerted as the valve is actuated is compressive.

20 Claims, 19 Drawing Sheets

(56) References Cited

FOREIGN PATENT DOCUMENTS

| | | | |
|---|---|---|---|
| DE | 102007033757 | A1 | 1/2009 |
| EP | 0634564 | A1 | 1/1995 |
| GB | 2017820 | | 10/1979 |
| JP | 58081304 | | 6/1983 |
| JP | 59126009 | A | 7/1984 |
| JP | 7102923 | A | 4/1995 |

* cited by examiner

LOST MOTION VALVE CONTROL APPARATUS

CROSS-REFERENCE TO RELATED APPLICATIONS

This application is a national stage filing based upon International PCT Application No. PCT/EP2010/061358, with an international filing date of Aug. 4, 2010, which claims the benefit of priority to Great Britain Patent Application No. 0913519.5, filed Aug. 4, 2009, and China Patent Application No. 200910161581.6, filed Aug. 4, 2009, the disclosures of which are fully incorporated herein by reference as though fully set forth herein.

FIELD OF THE INVENTION

This invention relates to valve control apparatus for use in internal combustion engines, to transmit motion from a cam lobe profile of an engine cam shaft to an engine valve.

BACKGROUND TO THE INVENTION

It is well known that internal combustion engines use valves, both intake and exhaust valves, to control the admittance of the air/fuel mixture to the cylinders. Typically, the opening and closing pattern of these valves is governed by cam lobes rotating on the engine camshaft. Each cam has a base circle and a lobe and a mechanical linkage links the cam to a valve. Whilst the linkage follows the base circle, the valve remains stationary but when that linkage follows the lobe portion of the cam it is caused to push the valve open. Typically, as the linkage moves from the cam lobe back to the base circle, the valve closes under spring action.

It is known that a single cam can have two cam lobe profiles to give different valve opening/closing events. Variable valve actuation is well known and allows the mechanical linkage to transfer a portion of the total movement to the valve that would otherwise all be transferred. In this way the engine valves can be made to open and close with different timings depending on the operation required from the engine.

One such operation is engine braking. Rather than following the typical combustion cycle, an internal combustion engine can be used as a brake if it is simply allowed to compress the air in its cylinders rather than burning fuel. Once the air in a cylinder has been compressed, the energy put into compressing that air must be released and this is typically accomplished by opening an engine exhaust valve close to top dead centre of the compression stroke. However, forces generated on the engine components during engine compression braking can be higher than during normal operation. During normal engine operation, the exhaust valve is normally opened when there is minimum pressure in the engine cylinder i.e. the piston is at or near bottom dead centre about to move upwards towards the cylinder head for the exhaust stroke. During an engine compression braking event however, the exhaust valve is opened when the contents of the cylinder are compressed and therefore under high pressure. Thus to open the exhaust valve in this situation requires that the cams and linkages driving the valve not only overcome the normal biasing force of the valve return spring but also the opposing pressure in the cylinder which acts to keep the valve shut.

Thus a need exists for an improved mechanical valve control device that allows the use of one or more cam profiles per cam but which is robust and simple and thus less likely to suffer failure in the harsh environment of the typical vehicle engine.

SUMMARY OF THE INVENTION

In accordance with a first aspect of the present invention, there is provided a valve control device for use in an internal combustion engine, the engine comprising an engine valve and a camshaft having a cam profile comprising a first lift profile, the valve control device comprising: a first body and a second body; wherein, the device is configurable in a first configuration and a second configuration, wherein, when the device is in the first configuration relative movement between said first body and second body caused when the first lift profile engages a cam engagement surface inhibits a valve actuating linkage from actuating the engine valve, the device comprising means which when the device is in the second configuration prevents relative movement between said first and second bodies when the first lift profile engages the cam engagement surface to enable the valve actuating linkage to actuate the engine valve characterised in that, when the device is in the second configuration, said means is arranged such that substantially all of the force exerted thereon as the valve is actuated is compressive.

This improves over known arrangements in which the force exerted on the means for preventing relative movement also includes a component of shear and/or torque. Purely compressive forces are easier to withstand than those including an element of shear and/or torque and thus embodiments of the present invention are more durable then known arrangements, particularly when exposed to the high loads of an engine breaking event.

DESCRIPTION OF THE DRAWINGS

Various embodiments of the invention will now be described with reference to the attached figures in which.

DETAILED DESCRIPTION

First Embodiment

Figure 1:
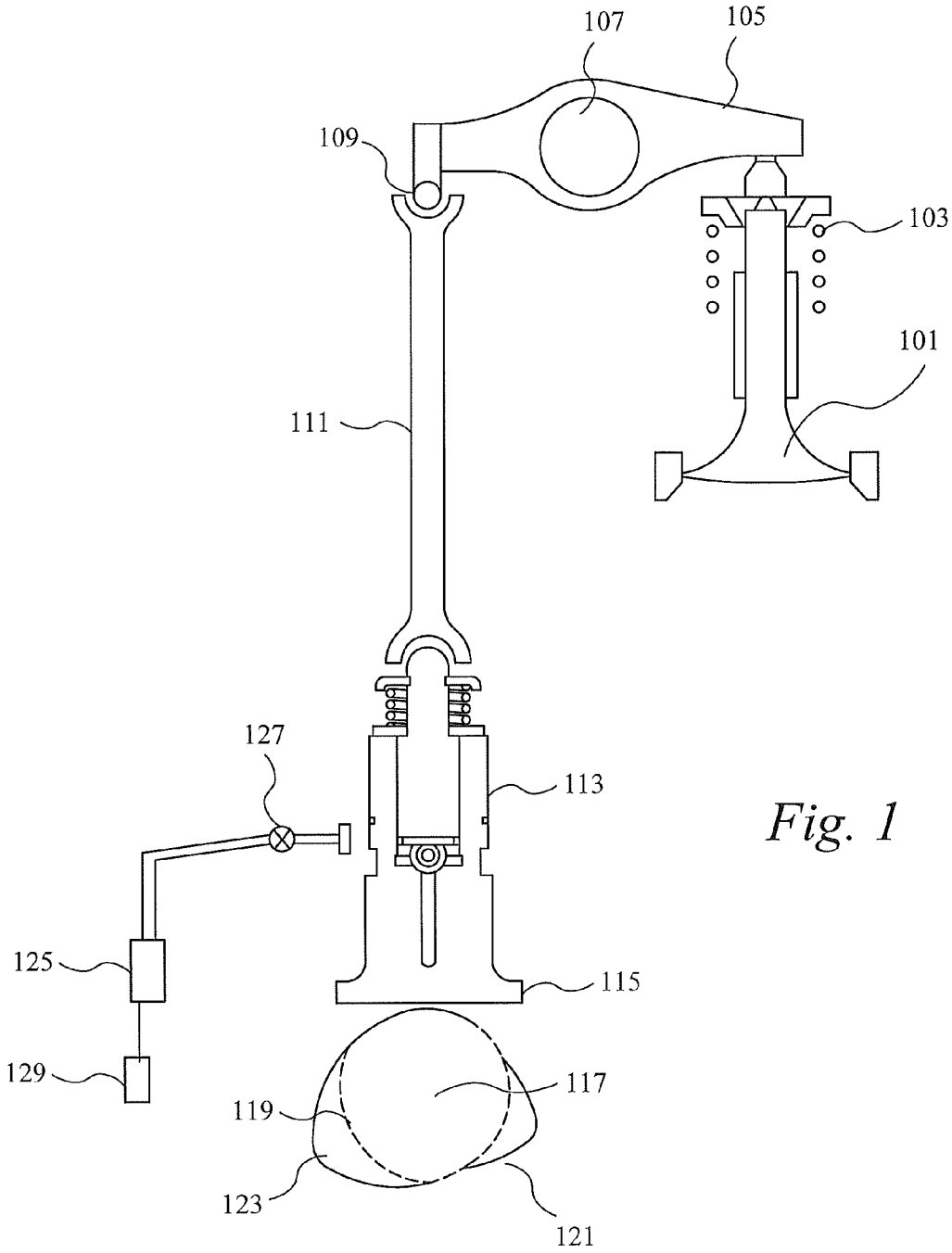
FIG. 1 shows a schematic representation of a valve lifter according to a first embodiment of the invention in relation to a cam, a push rod, a rocker arm, and an engine valve.

FIG. 1 shows an arrangement of components typically found in an internal combustion engine (the cylinder block is not shown for clarity). An engine valve 101 is mounted in an opening into the cylinder block of an engine and is arranged to block the opening to the engine block. The valve is maintained in the closed position by a valve spring 103. A rocker arm 105 is provided, mounted to rotate about a central pivot point 107, with one arm of the rocker in contact with the top of the valve 101. The arm of the rocker on the other side of the pivot point 107 has a protruding member 109. A push rod 111 is provided having an attachment point at one end that interfaces with the protruding member 109 on the rocker arm. At the opposite end of the push rod 111, a second interface is provided for interfacing with a valve lifter 113. The valve lifter 113 interfaces with the push rod at its top end and has a cam following surface 115 at its base. The cam following surface is in contact with a cam 117 that is formed on a camshaft (not shown) of the engine.

The cam 117 consists of a base circle 119 and two cam lobes 121, and 123 respectively which appear as bumps of different heights on the otherwise circular cam. Cam lobe 121 corresponds to an engine-braking mode of operation, whilst cam lobe 123 corresponds to a normal combustion mode of operation and is taller than the cam lobe 121 that corresponds to the engine-braking mode of operation.

As the cam 117 rotates (as a result of the cam shaft on which it is mounted being suitably driven by a linkage from the engine—not shown), the cam following surface 115 of the valve lifter 113 follows the contours of the cam and rise and falls as it traverses over the bumps of the cam lobes 121, 123. Accordingly, as the valve lifter rises and falls, it causes the push rod to travel upwards and downwards in sympathy. The push rod in turn pushes the protruding member 109 of the rocker arm 105 to move up and down. Due to the pivot in the rocker arm 105, rather than travelling vertically upwards and downwards when pushed by the push rod 111, the protruding member 109 rotates about the pivot point 107. As the protruding member rotates in a clockwise direction around the pivot point 107 (i.e. the valve lifter and push rod are moving upwards), the arm of the rocker in contact with the valve 101 is also driven to rotate clockwise and presses down upon the valve 101, moving the valve into the open position against the returning force supplied by the valve spring 103. As the valve lifter 113 and push rod 111 move downwards, the rocker arm rotates anti-clockwise and the valve 101 moves to the closed position, aided by the returning force of the valve spring 103.

An oil supply system 125 is provided, together with an Oil Control Valve 127 which together are operable to supply oil to the valve lifter 113 in the manner described below. The oil supply system may be integrated with the standard oil system typically found in automotive engines or it may be a stand alone, self-contained, unit specifically designed to supply oil to the valve lifter 113. The oil supply system 125 and Oil Control Valve 127 are electrically coupled to, and controlled by, an engine control unit 129.

Figure 2:
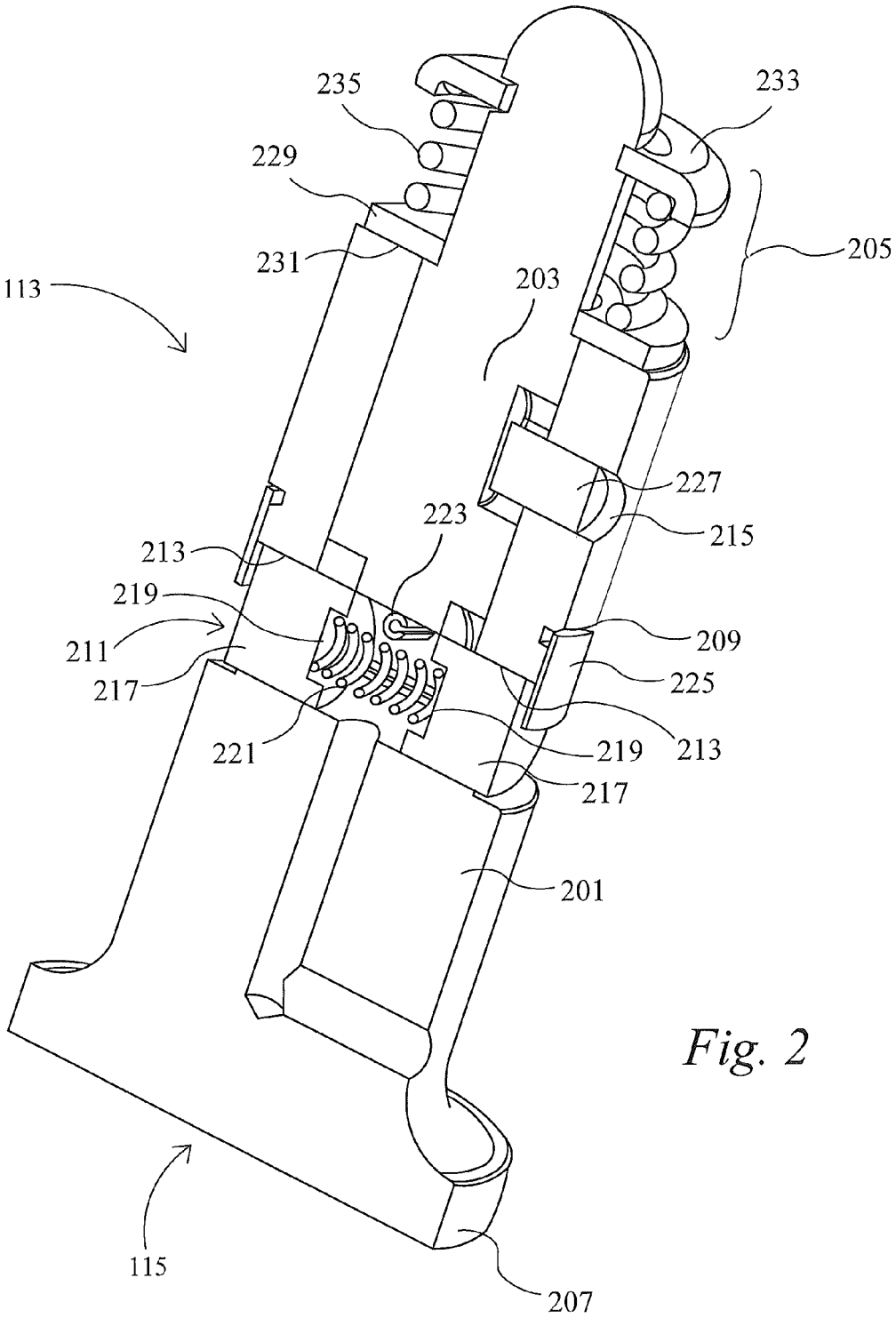
FIG. 2 shows a more detailed diagrammatical view of the valve lifter of FIG. 1.
Figure 3:
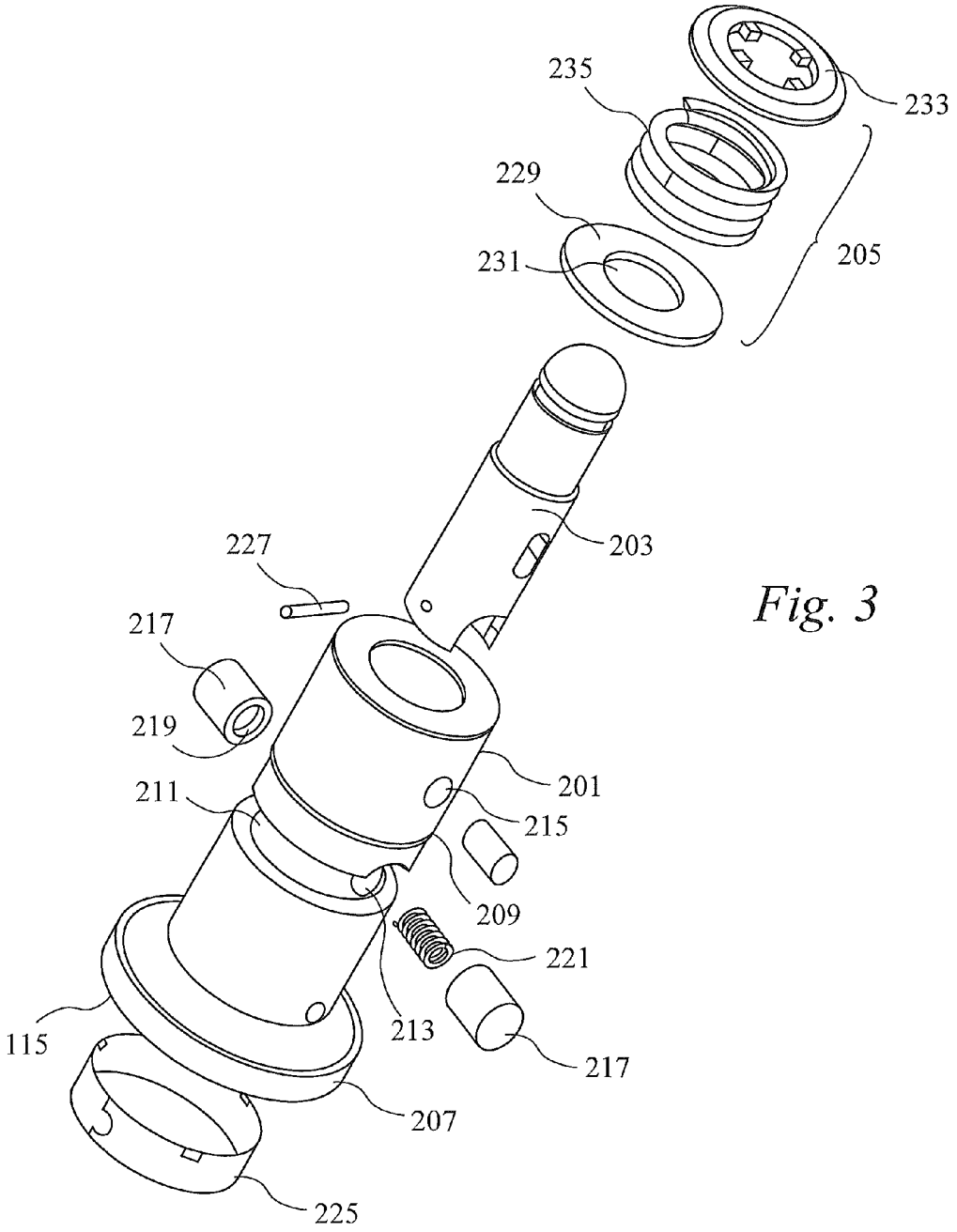
FIG. 3 shows an exploded projection of the valve lifter illustrated in FIG. 2.

With reference to FIGS. 2 to 5, an engine valve lifter in accordance with a first embodiment of the present invention will now be described. As shown in FIGS. 2 and 3, the valve lifter 113 of the comprises three main portions; an outer body 201, an inner body 203 and a lost motion section 205. The arrangement of the outer body 201 will be described with further reference to FIGS. 4A and 4B.

Figure 4A:
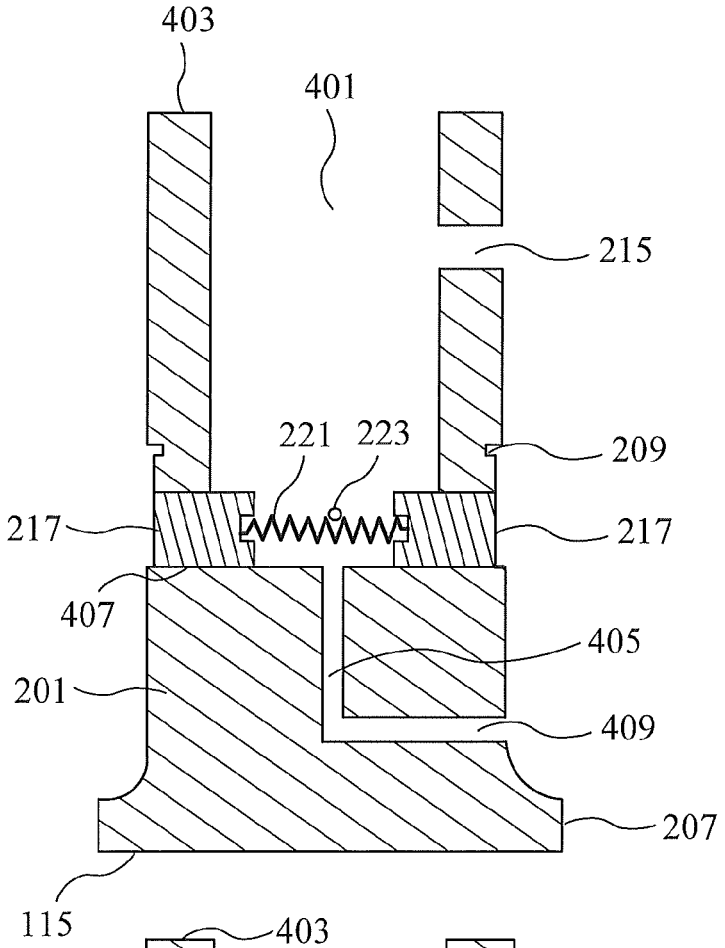
FIG. 4A shows a cross sectional view of a portion of the valve lifter of FIG. 2.
Figure 4B:
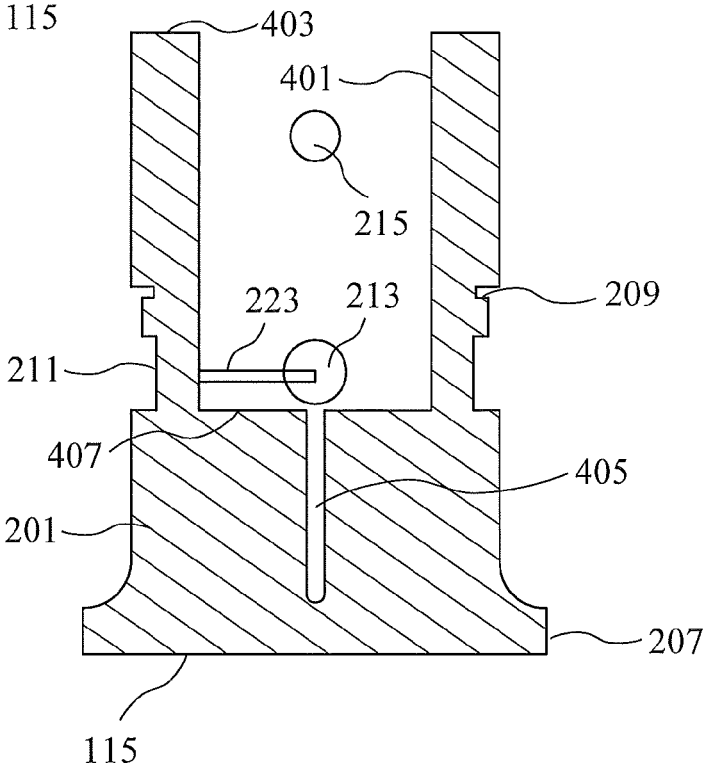
FIG. 4B shows a cross sectional view of the portion of the valve lifter perpendicular to the view of the portion of the valve lifter shown in FIG. 4A.

The outer body 201 comprises a substantially solid cylindrical shape. Towards the base of the outer body 201, the cylindrical walls flare outwards to create a base 207, the underside of which is the cam following surface 115. The base 207 has a diameter greater than that of the rest of the outer body 201. As best seen in FIGS. 4A and 4B, a longitudinal bore 401, having a constant cross section, penetrates from the top surface 403 of the outer body 201 towards the base 207 of the outer body 201 along its longitudinal axis. The longitudinal bore 401 does not extend all the way from the top surface 403 to the base 207 of the outer body 201 but instead extends to approximately the midpoint of the outer body 201 as shown in FIGS. 4A and 4B. At the midpoint, the longitudinal bore 401 narrows abruptly to a vertical tube 405 having a diameter smaller than the longitudinal bore 401 so that an annular surface 407 is formed. The vertical tube 405 penetrates further towards the base 207 of the outer body 201 until it terminates at a perpendicular intersection with a horizontal tube 409. The horizontal tube 409 has the same diameter as the vertical tube 405 and passes through to the exterior of the outer body 201 above the flared section of the base 207. The vertical tube 405 and the horizontal tube 409 comprise a path through which oil is able to drain from the cavity in the valve lifter 113 defined by the latch pins 217, the base of the longitudinal bore 401 in the outer body 201, and the base of the inner body 203.

An annular groove 209 is disposed around the circumference of the outer body. A larger annular indentation 211 is formed in the outside surface of the outer body 201, the bottom of the annular indentation 211 being level with the annular surface 407 at the base of the internal longitudinal bore 401. The thickness of the wall between the exterior of the outer body 201 and the internal longitudinal bore 401 is lesser at the annular indentation 211 than at other places along the longitudinal bore 401. Two diametrically opposed circular openings 213 are formed in the wall of the outer body 201 at the location of the annular indentation 211. The two circular openings 213 each pass into the longitudinal bore 401 with the base of each circular opening 213 level with the annular surface 407 formed at the base of the longitudinal bore 401. A third circular opening 215 is formed in the wall of the outer body 201, above the level of the first annular groove 209, and connects the internal longitudinal bore 401 with the exterior of the outer body 201.

Two latch pins 217 are provided, each comprising a small solid cylinder and having a circular indentation 219 on its base. The two latch pins 217 are connected to each other by a return spring 221, respective ends of which locate in the aforementioned circular indentations 219 in each latch pin 217. The latch pin 217 and return spring 221 assembly is inserted into the outer body 201 via the two diametrically opposed circular openings 213. The diameter of the latch pins 217 are matched to fit the diameter of the two diametrically opposed openings 213. When located in the outer body 201, each latch pin 217 resides with a portion of its length within the longitudinal bore 401 and the remaining portion passing through a respective one of the diametrically opposed openings 213 in the wall of the outer body 201 to the exterior. Since the diametrically opposed openings 213 are formed at the location of the annular indentation 211 in the outer body 201, the portion of the latch pin 217 protruding to the exterior of the outer body 201 is of sufficient length that it does not protrude beyond the outside diameter of the outer body 201 where it does not have the annular indentation 211.

In this arrangement, the respective latch pins 217 are able to move inwards towards one another, along an axis of travel perpendicular to the longitudinal axis of the outer body 201, when a force is applied to their exterior surfaces. The return spring 221 will be compressed as the two latch pins 217 move towards each other. A stop pin 223 is located within the longitudinal bore 401 between the two latch pins 217. The stop pin 223 serves to limit the inward travel of the latch pins 217 which are forced to stop when their rear surfaces abut respective surfaces of the stop pin 223. When the external force is removed from the latch pins 217, the return spring 221 will expand and attempt to push the latch pins 217 apart until the elastic energy in the return spring 221 is spent. In its uncompressed state, the return spring 221 is of sufficient length that the latch pins 217 are located with respect to the exterior surface of the outer body 201 as described above.

A retaining ring 225 (not shown in FIGS. 4A and 4B for clarity) is positioned around the exterior of the outer body 201, such that the top of the retaining ring 225 locates into the annular groove 209 formed in the outer body 201. The retaining ring 225 extends vertically downwards such that it partially encompasses the annular indentation 211. Thus, it can be readily seen that the retaining ring 225, whilst not in immediate contact with the exterior surfaces of the latch pins 217, serves to stop the latch pins 217 exiting the outer body 201.

Figure 5:
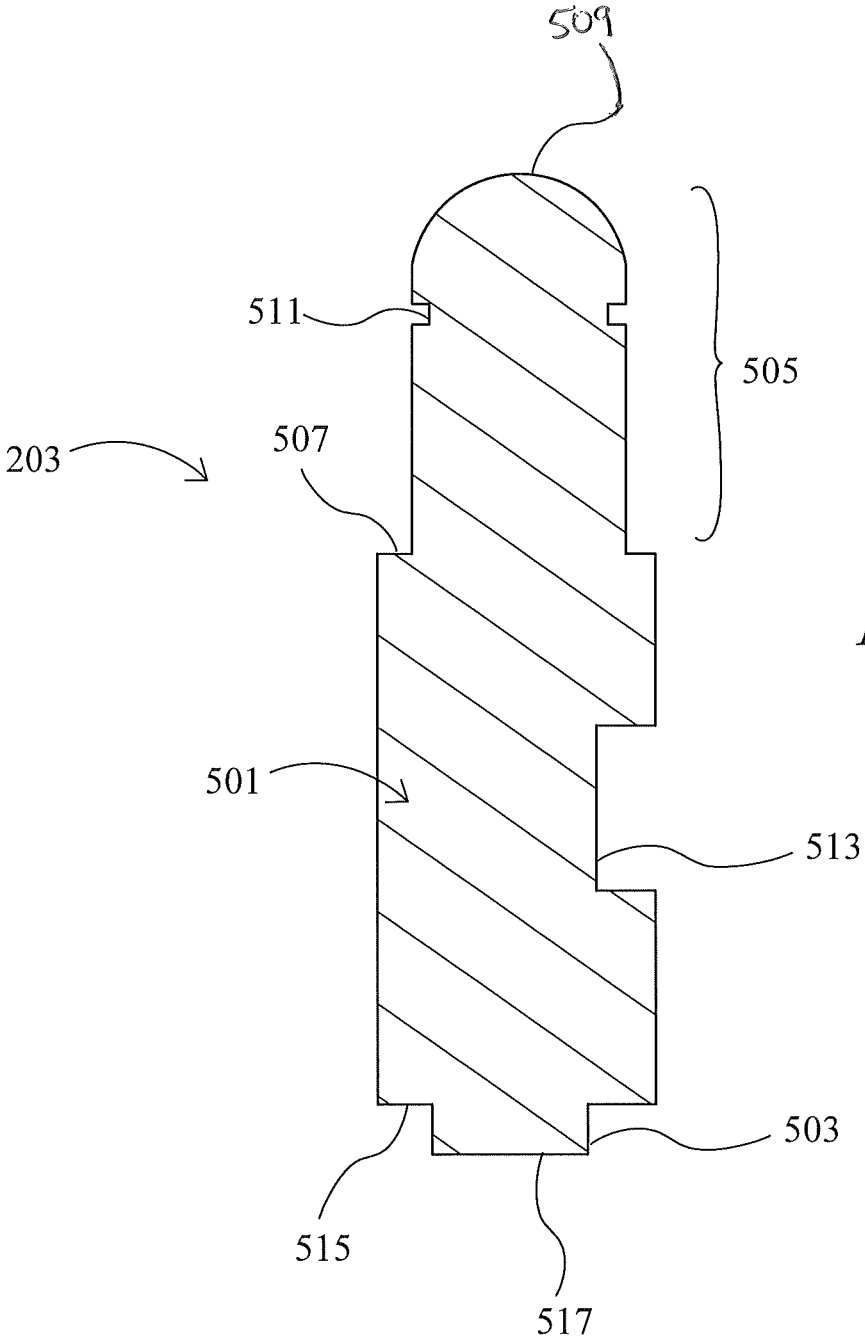
FIG. 5 shows a diagrammatical view of another portion of the valve lifter of FIG. 2.

Referring to FIGS. 2, 3, and 5, the inner body 203 comprises a central solid cylindrical section 501 having an external diameter equal to the diameter of the longitudinal bore 401 of the outer body 201. At one end of the central solid cylindrical section 501 a cylindrical protrusion 503 extends a short distance. The axis of the cylindrical protrusion 503 is concentrically located with that of the central solid cylindrical section 501 but its diameter is less than that of the central section 501 as shown in FIG. 5. Where the change in diameter from the central section 501 to the cylindrical protrusion 503 occurs, an annular flange 515 is created. At the end opposite to the cylindrical protrusion 503, the central section 501 extends into a connecting section 505. The diameter of the connecting section 505 is less than that of the central solid cylindrical section 501 but greater than that of the cylindrical protrusion 503. Where the change in diameter from the central section 501 to the connecting section 505 occurs, an annular flange 507 is created. The end of the connecting section 505 distal from the central section 501 terminates in a dome 509. The dome 509 of the connecting section 505 interfaces with the push rod 111. Located beneath the dome 509 of the connecting section 505 is an annular groove 511.

An oblong recess 513 is formed in the surface of the central section 501 of the inner body 203. The recess 513 has a width equal to the diameter of the third opening 215 in the outer body 201 but a length that is longer than the diameter.

As can be seen from FIGS. 2 and 3, the inner body 203 is located within the longitudinal bore 401 of the outer body 201 and the outer body 201 is arranged to slide reciprocally about the outer body 203. The third opening 215 in the outer body 201 is coincident somewhere along its length with the oblong recess 513 of the inner body. A range-limiting pin 227 is inserted through the third opening 215 in the outer body 201 so that a portion of the range-limiting pin 227 resides in the third opening 215 and the remaining portion resides in the oblong recess 513 of the inner body 203. Thus as the outer body 201 slides upwards with respect to the inner body 203 contained in the longitudinal bore 401, it reaches a limit of travel when the range-limiting pin 227 (which remains stationary with respect to the outer body 201) reaches the top of the oblong recess 513 and, as the outer body 201 slides downwards with respect to the inner body 203 contained in the longitudinal bore 401, it reaches a limit of travel when the range-limiting pin 227 (which again remains stationary with respect to the outer body) reaches the bottom of the oblong recess 513.

The length of the inner body 203 is such that when located within the outer body 201, the annular flange 507 is level with the top surface 403 of the outer body 201 and the bottom surface 517 of the cylindrical protrusion 503 is level with the top of the latch pins 217. The diameter of the cylindrical protrusion 503 and the spacing of the latch pins 217 (when the return spring 219 is in the relaxed state) is such that when the latch pins 217 are not subject to a force on their exterior surfaces, the separation between their rear surfaces is sufficient to allow the cylindrical protrusion 503 to pass between them as the outer body 201 moves upwards around the inner body 203 contained within the longitudinal bore 401. As the outer body 203 continues to move upwards with respect to the inner body 203, the upper surfaces of the latch pins 217 come to rest against the annular flange 515 at the bottom of the inner body 203 thus limiting any further upwards movement of the outer body 201 with respect to the inner body 203. This contact occurs at the same time as the range-limiting pin 227 reaches the upper end of the oblong recess 511.

Referring again to FIGS. 2 and 3, a circular stop plate 229 is connected to the top surface 403 of the outer body 201. An opening 231 in the circular stop plate 229 is provided through which the connecting section 505 of the inner body 203 passes. The opening 231 in the stop plate 229 is sized so that only the connecting section 505 of the inner body 203 can pass through, and the stop plate 229 makes contact not only with the top surface 403 of the outer body 201 but, depending on the position of the outer body 201 relative to the inner body 203, some times also with the annular flange 507 of the inner body 201. A second annular plate 233 is seated in the annular groove 511 on the connecting section 505 and a "lost motion" spring 235 surrounds the protruding portion of the connecting section 505, the spring 235 being attached at respective ends to the circular stop plate 229 and the annular plate 233 respectively. It should be noted that the force required to compress the lost motion spring 235 is much lower than the force required to overcome the valve spring 103 and thereby open the valve 101 by pushing the push rod 111 upwards. Accordingly, the lost motion spring 235 will compress before the push rod 111 moves.

Referring to FIGS. 6A, 6B, 6C, and 7, the operation of the engine valve lift apparatus will now be described in greater detail.

Figure 6A:
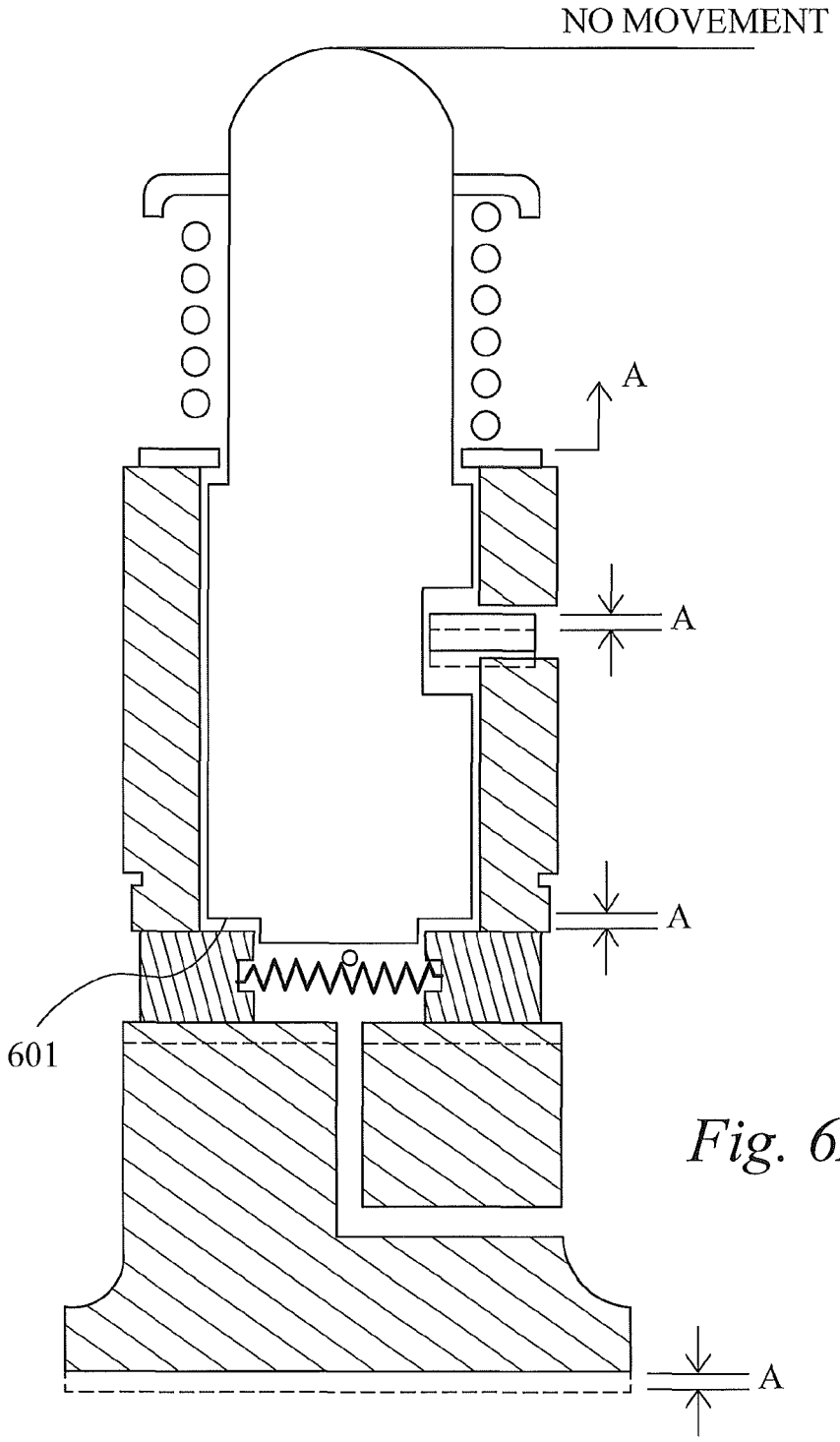
FIG. 6A shows a diagrammatical view of a part of the cycle of operation showing how the valve lifter responds to an engine-braking cam lobe when in normal combustion mode.
Figure 6B:
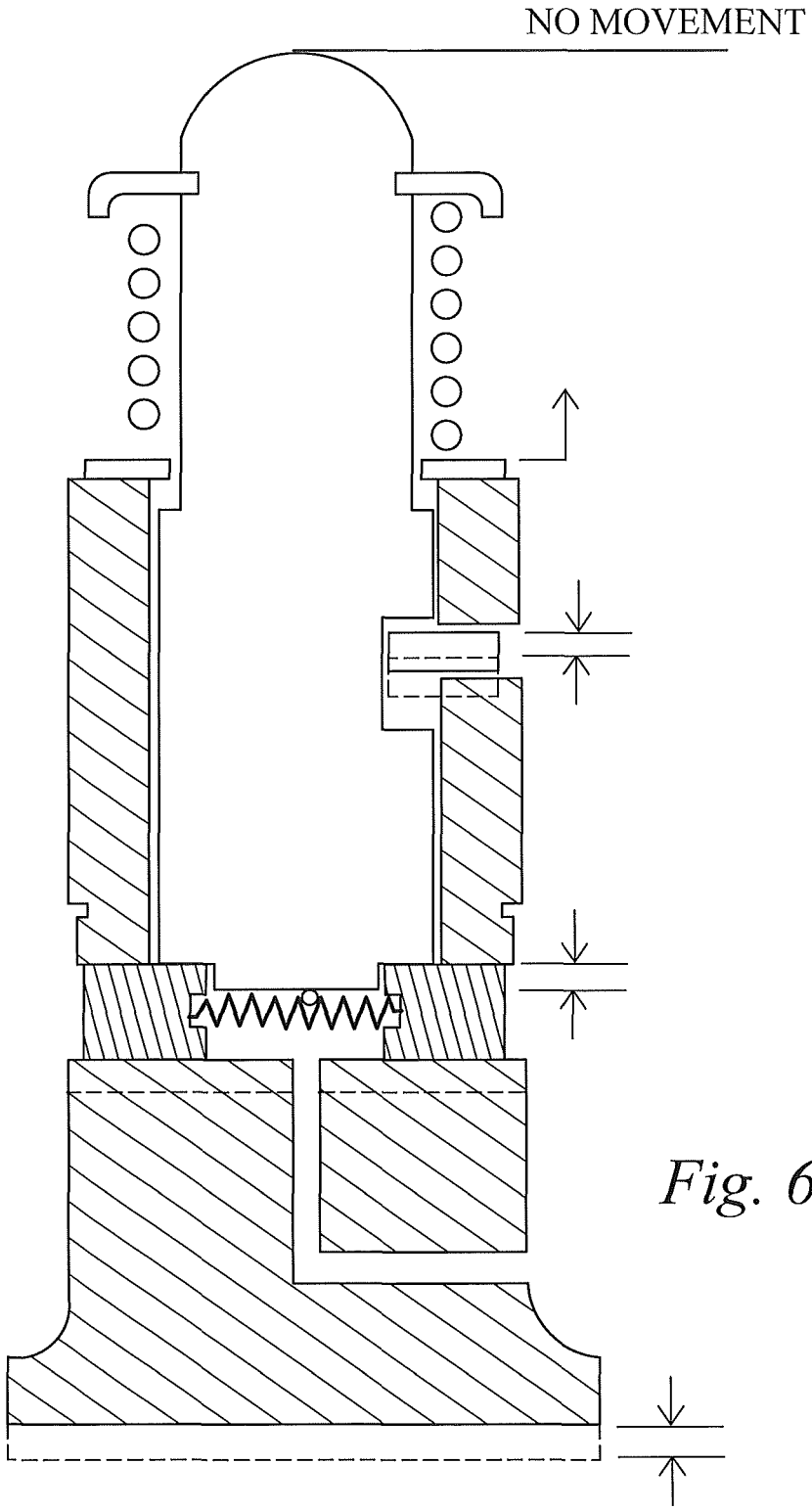
FIG. 6B shows a diagrammatical view of a part of the cycle of operation showing how the valve lifter responds to an normal combustion cam lobe when in normal combustion mode.
Figure 6C:
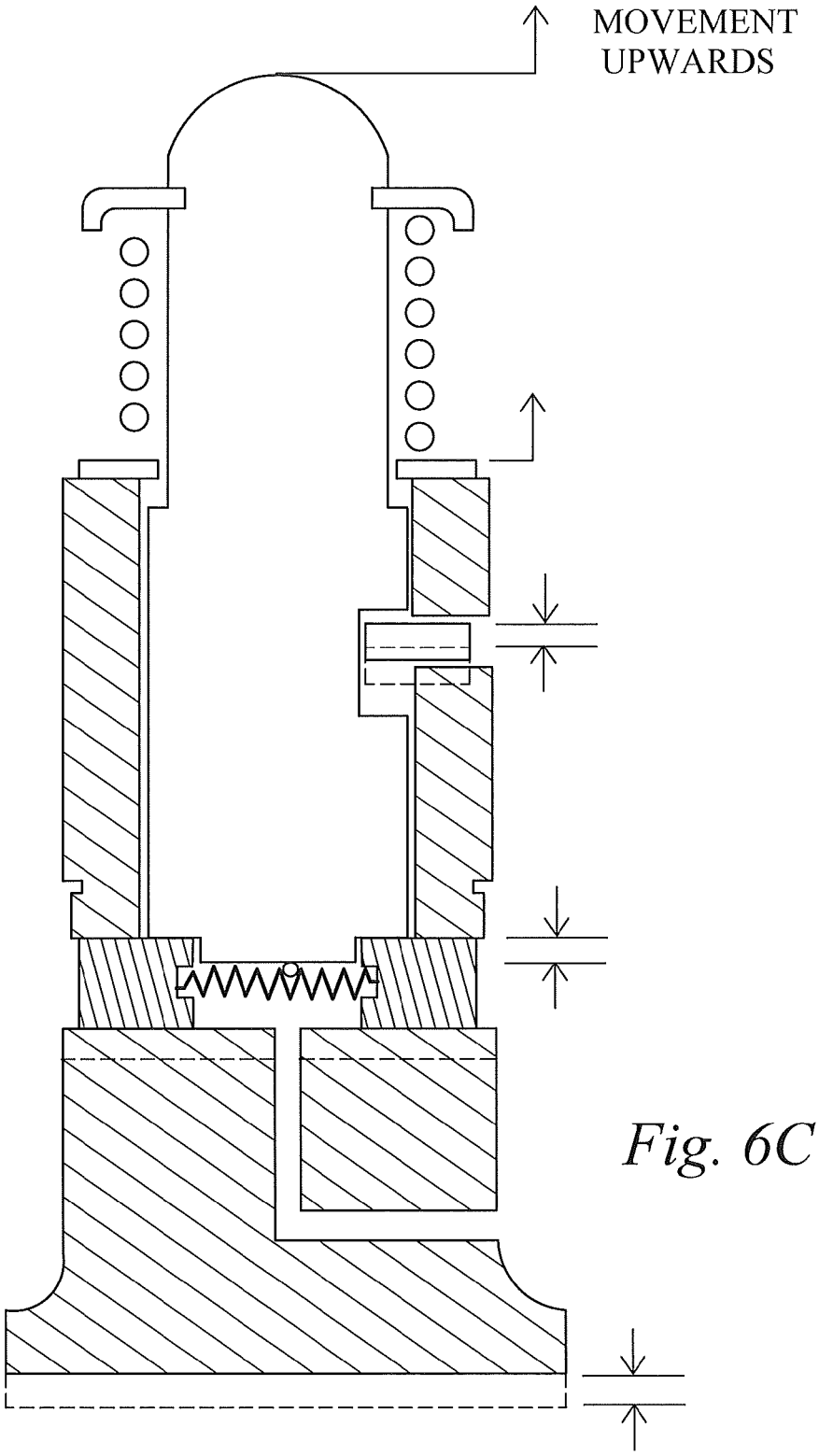
FIG. 6C shows a diagrammatical view of a further part of the cycle of operation shown in FIG. 7B.
Figure 7:
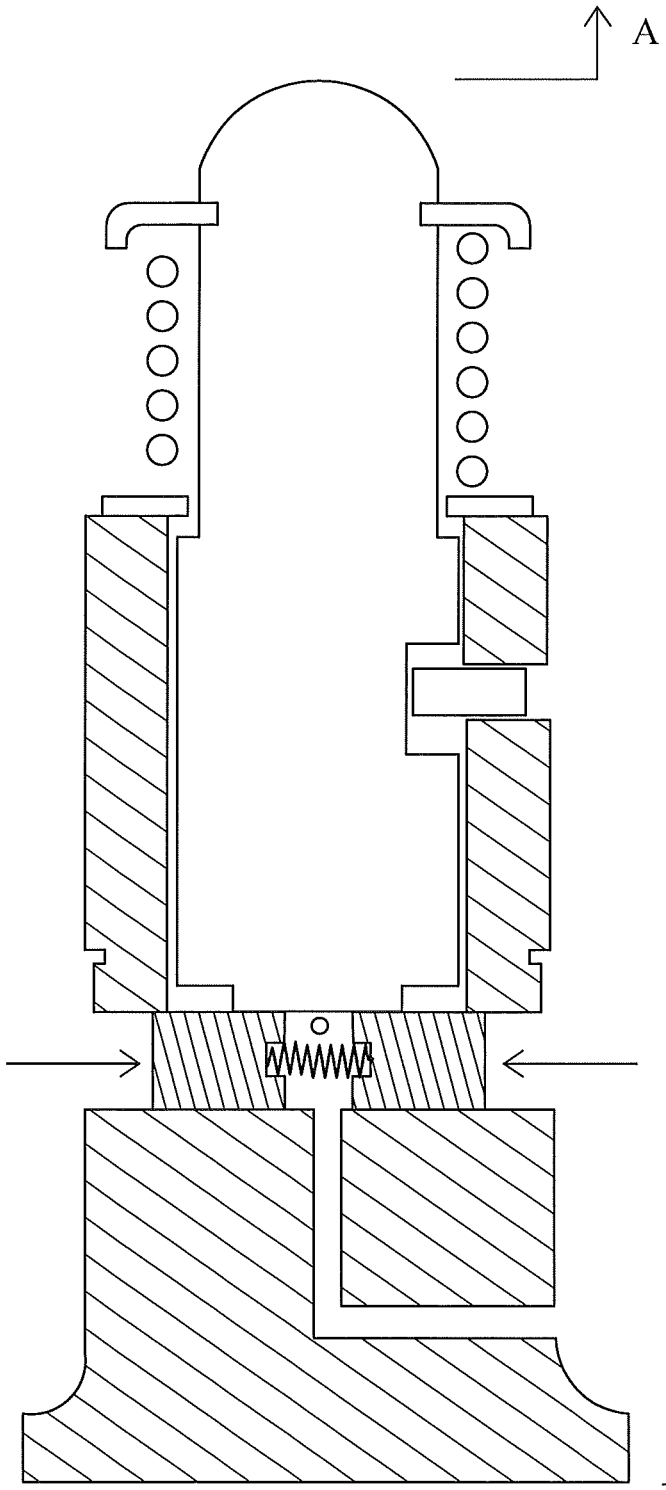
FIG. 7 shows a diagrammatical view of a part of the cycle of operation showing how the valve lifter responds to cam lobes when in engine-braking mode.

As the cam 117 on the engine camshaft rotates, the lobes 121, 123 on the cam 117 corresponding to normal combustion mode and engine braking mode will be presented in turn to the cam following surface 115 of the outer body 201 of the valve lifter 113. In normal combustion mode, the latch pins 217 of the valve lifter 113 will be in the unlatched position as shown in FIGS. 6A, 6B, and 6C, i.e. the return spring 219 is uncompressed and the latch pins 217 are situated partially in the longitudinal bore 401 and partly protruding through the diametrically opposed openings 213. As the lobe 121 on the cam 117 that corresponds to the braking event rotates under the base 207 of the valve lifter 113, it will push the base 207 of the lifter 113 and hence the outer body 201 upwards. Because the force required to compress the lost motion spring 235 is low compared to the force required to overcome the valve spring 103 by way of actuating the push rod 111 to which the connecting section 505 of the lifter is in contact, the inner body 203 of the valve lifter 113 will remain stationary whilst the outer body 201 will move upwards and compress the lost motion spring 235. Although the latch pins 217 move upwards with the outer body 201, the range of upward movement of the outer body 201 caused by the engine braking lobe 121 is not sufficient to cause the latch pins 217 to come into contact with the annular flange 515 on the bottom of the inner body 203. Also, the range-limiting pin 227 simply moves upwards within the oblong recess 513 without reaching the end. Due to the separation between the latch pins 217, they simply pass either side of the cylindrical protrusion 503 of the inner body 203.

As shown in FIG. 6A, at the top of the upwards movement of the outer body 201 (i.e. the outer body has been pushed up the maximum distance A by the engine-braking cam lobe 121):

the lost motion spring 235 will have been compressed by the same distance A;

the range-limiting pin 227 will have moved upwards in the oblong recess 513 a distance A but will not have reached the top of the recess; and the upper surfaces of the latch pins 217 will have moved upwards towards the annular flange 515 of the inner body by a distance A (and, reciprocally, the cylindrical protrusion 503 will have moved downwards between the latch pins 217 a similar distance A)

However, a separation 601 will still exist between the outer body 201 and the inner body 203 and, accordingly, the inner body 203 will not rise in response to the engine-braking lobe causing the outer body 201 to rise. As such, the push rod 111 connected to the inner body 203 by way of the connecting section 505 will not be actuated.

Referring to FIGS. 6B and 6C, as the normal combustion mode cam lobe 123 is taller than the engine braking mode lobe 121, it causes the outer body 201 to rise further than the engine braking mode lobe 121 would do. Accordingly, the outer body 201 moves upwards as is the case when the engine-braking mode lobe 201 is in action and so initially, separation 601 will exist. In this case however, the outer body 201 continues to move upwards so that even though the latch pins 217 still pass either side of the cylindrical protrusion 503 of the inner body 203, the upper surfaces of the latch pins 217 contact the annular flange 515 at the bottom of the inner body 203. In addition, the range-limiting pin 227 reaches the top of the oblong recess 513 in the inner body 203 at the same time that the latch pins 217 contact the annular flange 515. This situation is shown in FIG. 6B where it can be seen that the distance moved by the outer body 201 with respect to the inner body 203 is greater than in the case for the engine-braking cam lobe 121 (shown in FIG. 6A). Additionally, FIG. 6B shows that the separation 601 is no longer present between the outer body 201 and the inner body 203. From this point onwards, the inner body 203 is forced to rise at the same rate as the outer body 201 and hence will actuate the push rod 111 and ultimately the engine valve 101. As the outer body 201 rises, the upwards force is transmitted through the latch pins 217 to the inner body 203, thereby making it move upwards also. The force being transmitted though the latch pins 217 acts to put them into compression.

As the normal combustion mode cam lobe 123 rotates over centre, the valve lifter 113 will begin to descend. The outer body 201 and inner body 203 will both descend in tandem until the engine valve 101 is closed (i.e. until there is no force exerted on the connecting section 505 of the inner body 203 from the push rod 111 to which it is attached). At the point that the engine valve 101 is closed, the inner body 203 will stop descending and the outer body 201 will continue to descend, pushed by the lost motion spring 235, until back to the position prior to the onset of the normal combustion mode cam lobe 123.

Thus it can be seen that with the latch pins in this first, unlatched, position the lift caused by the engine-braking cam lobe 121 will not be passed on to the engine valve 101, whilst the lift caused due to the normal combustion mode cam lobe 123 will be.

When engine-braking mode is required, an Oil Control Valve is opened to allow high pressure oil to contact the exterior surfaces of the latch pins 217. This pressure exerted on the exterior of the latch pins 217 by the high pressure oil forces them inwards towards one another. The latch pins 217 will move inwards towards one another until they come into contact with the stop pin 223 and are at the position shown in FIG. 7. This is the second, latched, position.

The latch pins 217 may fit within their respective diametrically opposed openings 213 such that none of the high pressure oil, or only a small amount of it, is able to pass around the latch pins 217 into the cavity behind the latch pins 217. In this case, once the latch pins 217 have been moved inwards towards the latched position, only a static pressure need be maintained on the oil pressing the latch pins 217 inwards. No, or little flow of oil will occur within the oil supply system. Whatever amount of oil that reaches the cavity behind the latch pins 217 will flow through the vertical and horizontal drain tubes (405, 409 respectively).

Alternatively, the latch pins 217 may fit within their respective diametrically opposed openings 213 such that high pressure oil can flow readily around the latch pins 217, from the exterior of the valve lifter 113 to the cavity behind the latch pins 217. In this case, the oil that reaches the cavity behind the latch pins will flow through the vertical and horizontal drain tubes (405, 409, respectively). In this arrangement, a steady flow of high pressure oil will be required, with the latch pins 217 being maintained in their inward, latched position by the high pressure oil flowing past them.

As the lobe 121 on the cam that corresponds to the engine-braking event rotates under the base 207 of the valve lifter 113, it will push the base 207 of the lifter 113 and hence the outer body 201 upwards. However, with the latch pins 217 in the "latched" position, as the outer body 201 begins to move upwards (driven by the cam lobe 121) the upper surfaces of the latch pins 217 impact on the cylindrical protrusion 503 of the inner body 203 and thus the inner body 203 is forced to move upwards together with the outer body 201. As the outer body 201 rises, the upwards force is transmitted through the latch pins 217 to the inner body 203, thereby making it move upwards also. The force being transmitted though the latch pins 217 acts to put them into compression. The outer body 201 does not compress the lost motion spring 235 in this situation as the whole assembly of outer body 201, inner body 203, and lost motion spring 235 all move upwards together. Thus the rise of the engine-braking cam lobe 121 is passed directly to the push rod 111 (and hence ultimately the engine valve 101 itself) by the valve-lifter which is effectively solid. In the latched mode of operation, the valve lifter 113 will rise and fall in direct response to the rise and fall caused by the cam lobes 121, 123. The opening force supplied to the engine valve 101 from the engine-braking cam lobe 121, via the valve lifter 113, push rod 111, and rocker arm 105 is not only sufficient to overcome the returning force of the valve spring 103 but is also sufficient to overcome the force exerted on the base of the engine valve 101 by the high pressure air within the engine cylinder that has been compressed during the engine braking event and acts to keep the engine valve 101 in the closed position.

When engine-braking mode is no longer required, the Oil Control Valve is closed and oil pressure is reduced on the external surfaces of the latch pins 217. When the external oil pressure is less than the returning force of the return spring 219 (which was compressed as the latch pins 217 moved inwards towards each other), the return spring 219 will force both of the latch pins 217 outwards, away from each other, back to the unlatched position. The valve lifter 113 will then once again behave as outlined above in relation to the normal combustion mode.

Thus it can be seen that with the latch pins 217 in this second, latched, position the lift caused by the engine-braking cam lobe 121 and the normal combustion mode cam lobe 123 will both be passed on to the engine valve 101.

It is also apparent that whether the upper surfaces of the latch pins 217 contact the cylindrical protrusion 503 of the inner body 203, or whether they contact the annular flange 515, the force transmitted through the latch pins from the outer body 201 in order to raise the inner body 203 is purely compressive in nature. The surfaces of the inner body 203 that contact the latch pins 217 do so on the upper surfaces of the latch pins 217 whilst the latch pins are supported fully by the outer body 201 along their bottom surfaces, thus there is no shear stress applied to the latch pins 217. Applying purely compressive forces to the latch pins results in a more robust arrangement, and hence the valve lifter 113 is less likely to fail during an engine braking mode of operation where the forces transmitted through the valve lifter are greater than during normal combustion due to the extra force need to open the engine valve against the compressed air charge in the cylinder.

Second Embodiment

A second embodiment of the engine valve lifter will now be described in which the arrangement of engine components differs from that of the first embodiment in that the engine incorporates an overhead cam shaft rather than a camshaft and pushrod. The apparatus and method of operation have many similarities to that described in reference to the first embodiment and like features will be denoted with like reference numerals.

Figure 8:
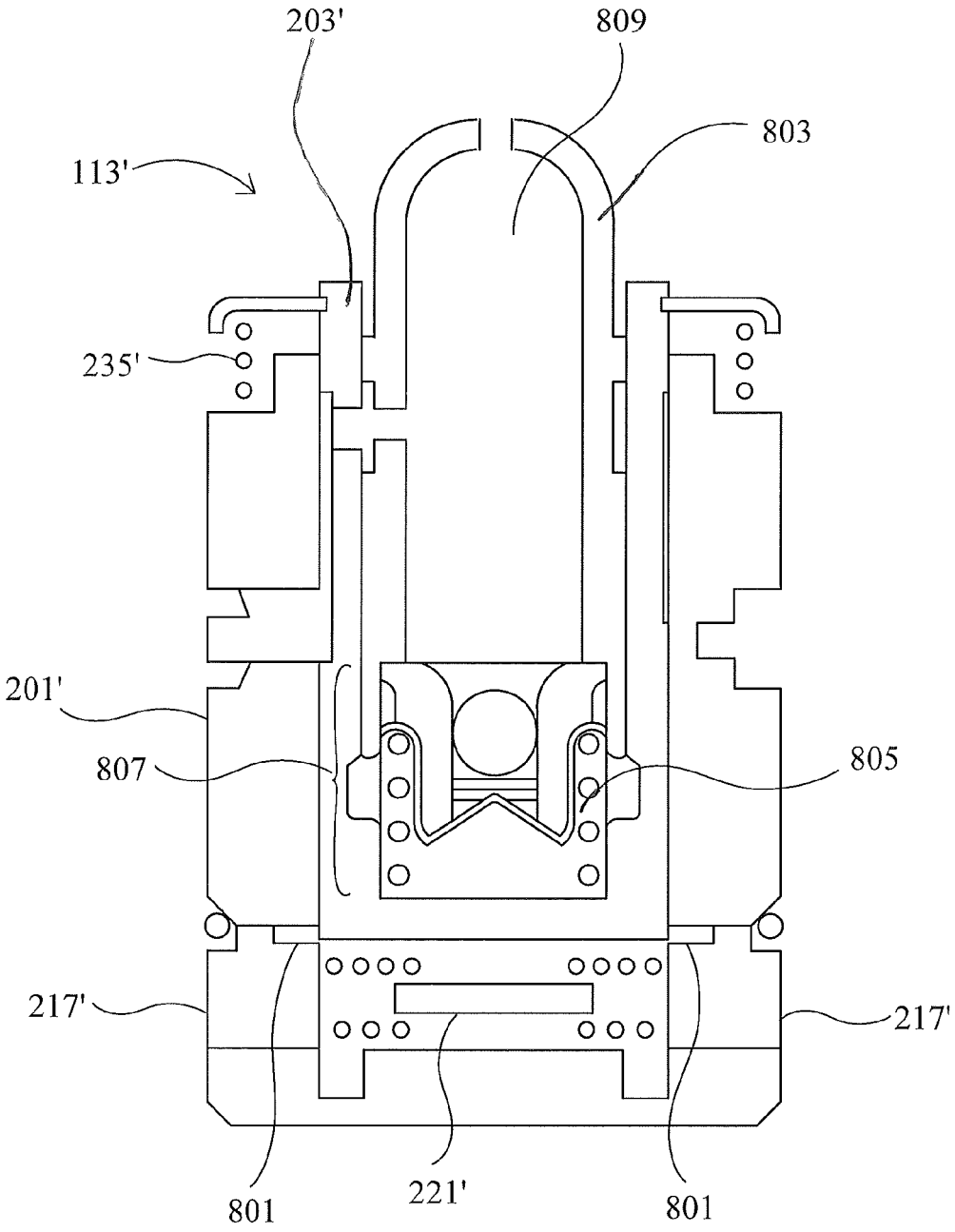
FIG. 8 shows a diagrammatical view of a valve lifter according to a second embodiment of the invention.

Referring to FIG. 8 a valve lifter 113' is depicted. In this second embodiment the inner body 203' is located within a bore of the outer body 201' such that reciprocal sliding motion of the inner body 203' relative to the outer body 201' is possible. In contrast to the first embodiment however, the base of the inner body 203' does not have a cylindrical protrusion but is instead flat.

The latch pins 217' are similar to those described in relation to the first embodiment but each incorporate a recessed shoulder 801 on the upper corner of their rear portion (i.e. the portion that rests furthest towards the centre of the outer body 201). Whereas, in the first embodiment, the upper surfaces of the latch pins 217 came into contact with either the cylindrical protrusion 503 of the inner body 203 or the annular flange 515, depending on whether the latch pins 217 were in the latched (i.e. pushed in towards the centre of the outer body 201) or unlatched position, in the second embodiment, if the latch pins 217' are in the unlatched position then the flat base of the inner body 203' is able to pass up and down between the respective rear surfaces of the latch pins 217 and when in the latched position, the flat base of the inner body 203' rests partially on the recessed shoulders 801 of the latch members 217'.

Whereas in the first embodiment the inner body 203 was solid, by contrast, in the second embodiment, the inner body 203' is hollow and incorporates a generally cylindrical plunger element 803. The generally cylindrical plunger element 803 is able to slide reciprocally up and down within the inner body 203'. The cylindrical plunger element 803 sits within the inner body 203' such that a high pressure chamber 805 for a hydraulic lash compensation element (where the hydraulic lash compensation element is generally designated as 807 in FIG. 8), is formed between the base of the cylindrical plunger element 803 and the base of the hollow inner body 203'. Lash compensation/adjuster mechanisms for use in automotive engines are well known and will not be described in further detail herein. However, in brief, the cylindrical plunger element 803 contains a fluid reservoir 809, which is in communication with the high pressure chamber 805 by means of the lash compensation element 807. The skilled person will be aware that the inner body 203' and cylindrical plunger element 803 generally move together as a single unit. Whereas in the first embodiment it is the uppermost section of the inner body 203 that is the uppermost part of the valve lifter, in this second embodiment it is the top of the cylindrical plunger element 803. The lash compensation element 807 is operable to alter the length of the cylindrical plunger element 803 protruding upwards from within the hollow inner body 203'.

Figure 9:
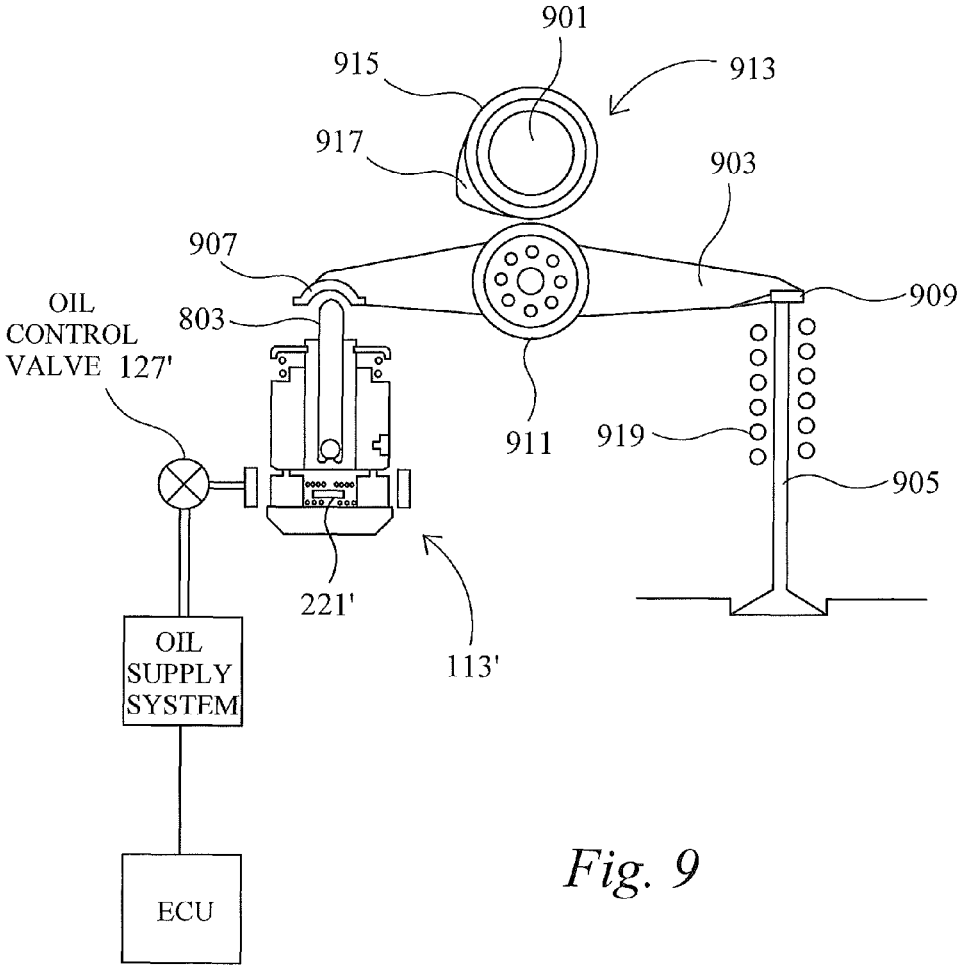
FIG. 9 shows a schematic representation of the valve lifter according to the second embodiment of the invention in relation to a cam, a rocker arm, and an engine valve.

The valve lifter of the second embodiment is designed to operate in an engine having a different arrangement of components to that described in relation to the first embodiment (as illustrated in FIG. 1). FIG. 9 shows the valve lifter of the second embodiment arranged for operation in an engine having an overhead cam shaft 901 as opposed to the cam shaft and push rod arrangement depicted in FIG. 1. In this arrangement, the outer body 201' of the valve lifter 113' is mounted rigidly either in the engine casing or by other mounting means. A rocker arm 903 is provided which interfaces with the top of the cylindrical plunger element 803 of the valve lifter at a first end and with a stem of an engine poppet valve 905 at the other end. The interface with the top of the cylindrical plunger element 803 may be by way of a hemispherical socket 907 at the first end of the rocker arm 903 matched to fit around the rounded top of the cylindrical plunger element 803 although other interface methods would be readily apparent to the skilled person. The interface with the stem of the engine poppet valve 905 may be a valve contacting pad 907 located on the second end of the rocker arm 903 where the underside of the valve contacting pad 909 contacts the top of the valve stem, although, again, other interface methods would be readily apparent to the skilled person. The rocker arm 903 includes a rotatable cam follower 911 which is in engagement with the surface of a valve actuating cam 913 (where the valve actuating cam 913 has a base circle portion 915 and a lift portion 917).

The engine poppet valve 905 is biased upwards into a closed position by a valve spring 919. The force required to compress the valve spring 919 and thereby cause the engine poppet valve 905 to open is higher than the force required to compress the lost motion spring 235' of the valve lifter.

In operation, the valve lifter 113' of the second embodiment is able to act as a valve deactivator so that a movement that would otherwise be transferred to the engine poppet valve 905 by the lift portion 917 of the valve actuating cam 913, via the rocker arm 903, is nullified.

When the latch pins 217' are in the unlatched position, the inner body 203' (including the cylindrical plunger element 803 and lash compensation element 807) is able to move up and down within the bore of the outer body 201'. As the inner body 203' moves downwards into the bore of the outer body 201', the separation between the rear surfaces of the latch pins 217' is sufficient to allow the inner body 203' to pass between them. The lost motion spring 235' opposes downward movement of the inner body 203' within the outer body 201' and acts to bias the inner body 203' towards a position where it protrudes maximally from the outer body 201'. As the lift portion 917 of the valve actuating cam 913 rotates it presses progressively against the rotatable cam follower 911 of the rocker arm 903 and causes displacement of the rocker arm 903. However, since the force required to compress the valve spring 919 is greater than the force required to compress the lost motion spring 235' of the valve lifter, the rocker arm 903 pivots around the top of the valve stem and pushes the inner body 203' of the valve lifter downwards, compressing the lost motion spring 235'. Thus when the latch pins 217' are in the unlatched position, the movement of the rocker arm 903 causes the inner body 203' of the valve lifter to move rather than the valve stem and hence the engine poppet valve 905 remains closed.

If, however, it is desired that the movement caused by the lift portion 917 of the valve actuating cam 913 be passed on to the engine poppet valve 905 as a "valve event" (i.e. the valve will open) then the latch pins 217' are moved to the latched position. The latch pins 217' are moved between the unlatched and the latched position in the same manner as outlined in relation to the first embodiment (i.e. pressurised oil is supplied to the exterior surfaces of the latch pins 217' by way of an Oil Control Valve 127 and suitable supply conduits. The pressure of the pressurised oil pushing on the exterior faces of the latch pins 217' forces them towards one another, in towards the centre of the valve lifter, compressing the return spring 221' in the process).

When the latch pins 217' are in the latched position, the inner body 203' is prevented from moving downwards into the bore of the outer body 201' because the base of the inner body 203' now rests on the recessed shoulders 801 of the latch pins 217'. Thus the lost motion of the valve lifter is anulled and the valve lifter acts as a rigid unit. There is no relative movement between the inner body 203' and outer body 201'.

With the inner body 203' and outer body 201' locked in this rigid arrangement, the force required to move the top of the inner body 203/cylindrical plunger element 803 downwards is far greater than the force required to compress the valve spring 919 (since the valve lifter is rigidly retained in the engine block or some other supporting structure). Consequently, as the rocker arm 903 is forced to move by the lift portion 917 of the valve actuating cam 913, the rocker arm 903 pivots around the top of the cylindrical plunger element 803, pressing downwards on the valve stem and thereby opening the engine poppet valve 905 against the returning force of the valve spring 919.

Since the latch pins 217' are located partially beneath the base of the inner body 203', any force applied to the top of the cylindrical plunger element 803 (by the rocker arm 903 for example) and passed onto the latch pins 217' will be a purely compressive force, with no element of shear stress on the latch pins 217'. Since compressive forces are more readily withstandable than shear stresses, the latch pins 217', and hence the valve lifter as a whole, is more robust and less susceptible to material and/or component failure.

Third Embodiment

Figure 10:
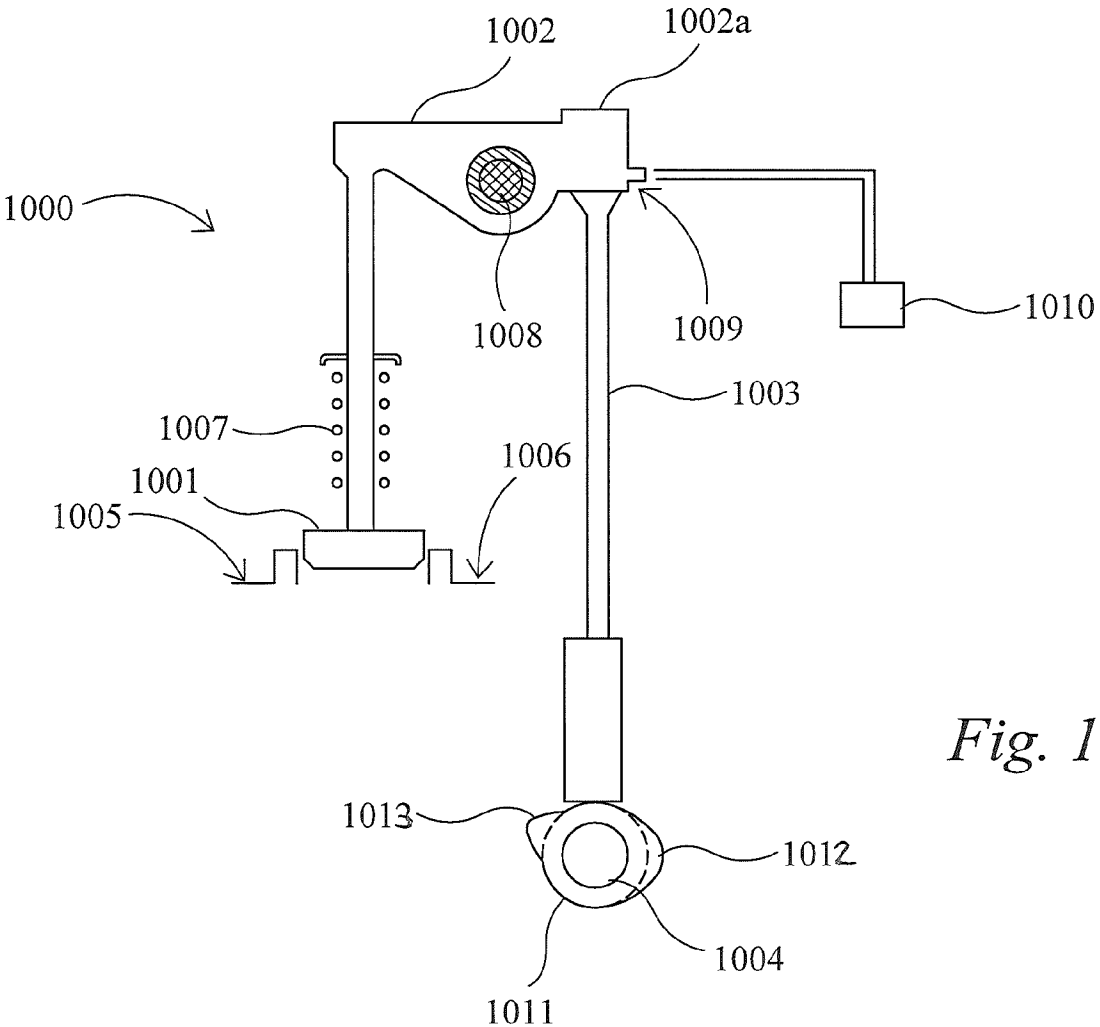
FIG. 10 shows a schematic representation of a valve lifter according to a third embodiment of the invention in relation to a cam, a rocker arm, and an engine valve.

FIG. 10 illustrates an engine valve system 1000 comprising an exhaust valve 1001, a rocker arm 1002, a push rod 1003 and a cam 1004. The exhaust valve 1001 is mounted in an exhaust opening 1005 of an engine block 1006 and a valve spring 1007 mounted around the stem of the valve is arranged to bias the valve 1001 to close the exhaust opening 1005. The rocker arm 1002 is rotatably mounted about a central pivot point 1008 and one end of the rocker arm 1002 is in contact with an upper end of the stem of the valve 1001. The rocker arm 1002 is provided at its other end with an integral housing 1002*a* that contains a valve control capsule 1009. One end of the valve control capsule 1009 interfaces with an end of the push rod 1003.

The system 1000 further comprises a valve control capsule control system 1010. As will be explained in more detail below, in this example, the control system 1010 comprise pneumatic actuator means for selectively configuring the valve control capsule 1009 in either an engine break ON mode or an engine break OFF mode.

The cam 1004 comprises a base circle 1011 and two cam lobes 1012 and 1013 respectively which appear as bumps of different heights on the otherwise circular cam. Cam lobe 1012 corresponds to an engine break mode of operation, whilst cam lobe 1013 corresponds to a normal combustion modes of operation. The cam lobe 1013 is taller than the cam lobe 1012.

When the camshaft (not shown) and hence the cam 1004 rotates, the push rod 1003 follows the contours of the cam and rises and falls as it traverses over the bump of the cam lobes 1012 and 1013.

Figure 11B:
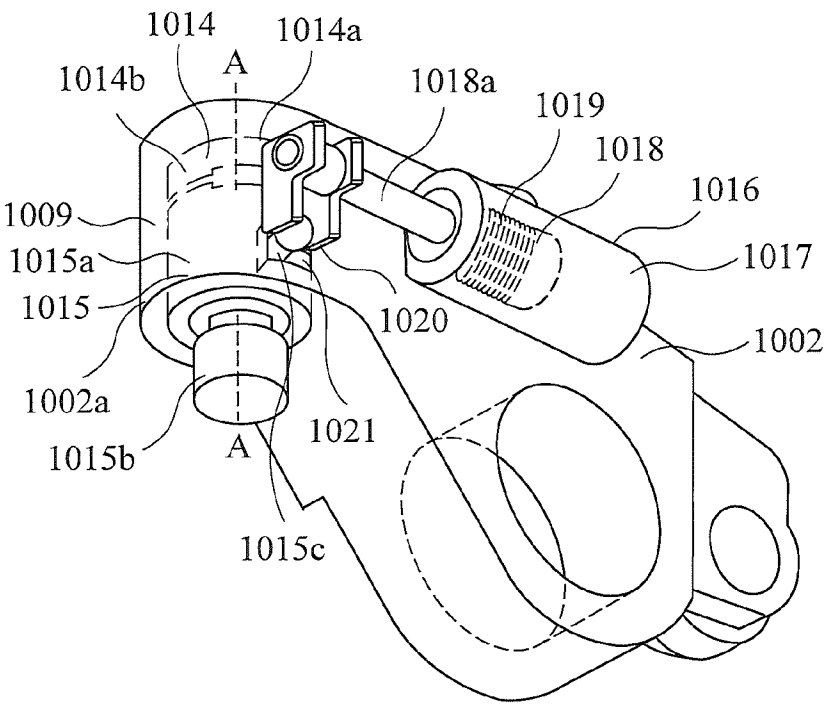
FIGS. 11*a*, 11*b* and 11*c* show schematic representation of the valve lifter according to the third embodiment in relation to a rocker arm.
Figure 11A:
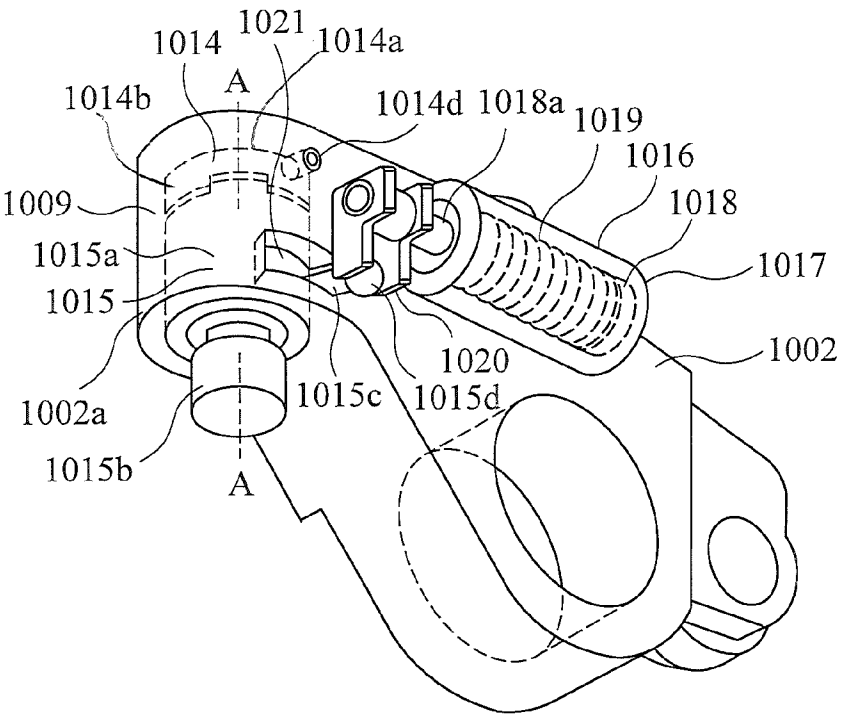
Figure 11C:
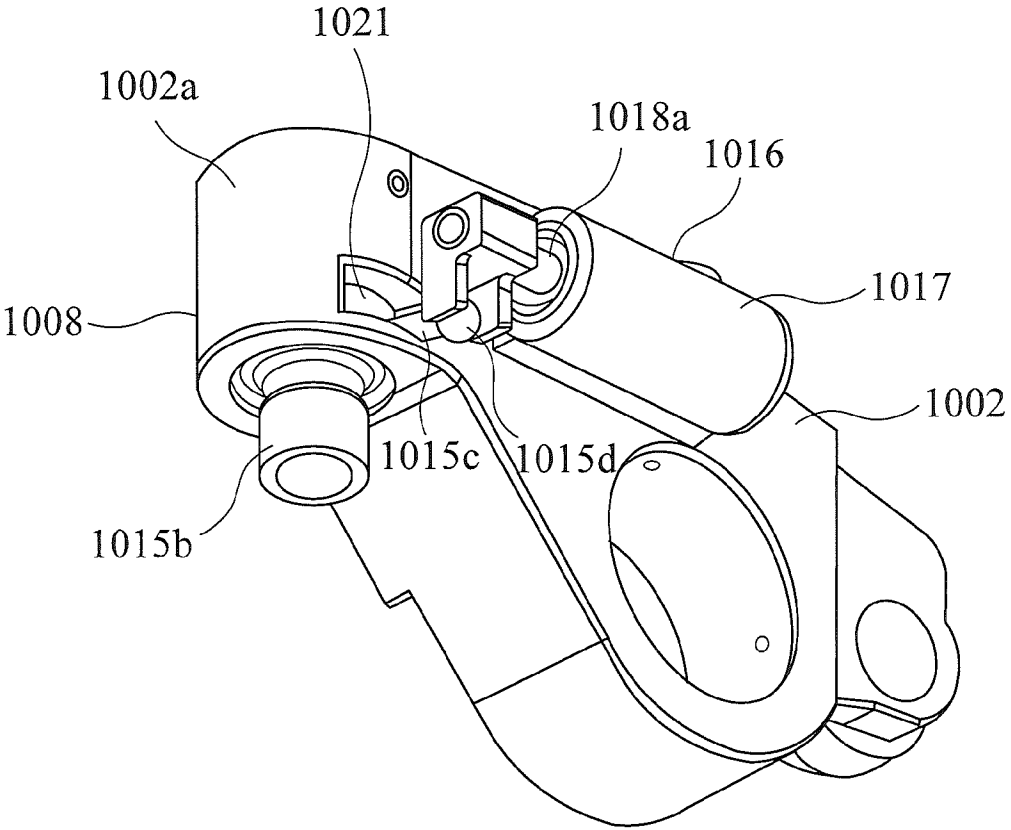
Figure 11D:
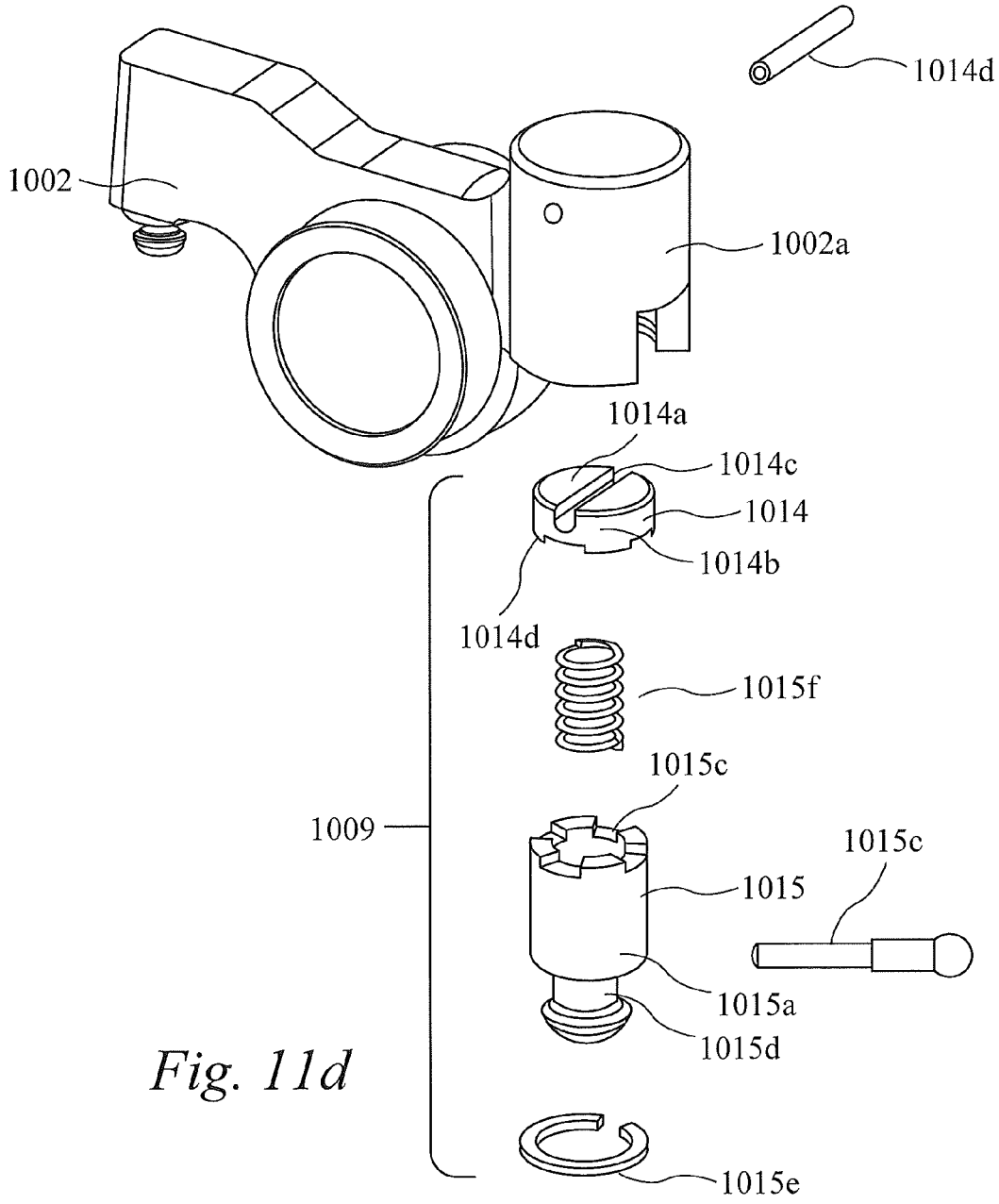
FIG. 11*d* illustrates an exploded view of a rocker arm and a valve lifter according to the third embodiment.

FIGS. 11*a* and 11*b*, illustrate the valve control capsule 1009 and the rocker arm 1002 in an engine break off configuration (FIG. 11*a*) and an engine break on configuration (FIG. 11*b*). It will be appreciated that in these two figures the rocker arm 1002 is shown as semi-transparent to allow the viewing of other of the components. For comparison, FIG. 11*c* provides the same view as FIG. 11*a*, except that the rocker arm 1002 is shown as opaque. FIG. 11*d* illustrates an exploded view of the rocker arm 1002 and the control capsule 1009.

The valve control capsule 1009 comprises a first body 1014 and a second body 1015. The first body 1014 is generally cylindrically shaped and comprises a base surface 1014*a* and a side surface 1014*b*. A groove 1014*c* is formed through the side surface 1014*b* and the base surface 1014*a* across a diameter of the base surface 1014*b* and the first body is supported within the housing 1002*a* by means of a support rod 1014*d* securely received in the groove 1014*c* and each end of which is fixed in a respective one of a pair of apertures formed on opposite sides of the housing 1002*a*.

The second body 1015 comprises a first part 1015*a* and a second part 1015*b* (not shown in FIG. 11*d*). Like the first body 1014, the first part 1015*a* is also generally cylindrical in shape (although it is relatively tall compared to the first body 1014), has a similar diameter as the first body 1014 and is supported within the housing 1002*a* very slightly below and co-axially with the first body 1014.

At its end away from the first body 1014, the first part 1015*a* comprises a projection 1015*d* (see FIG. 11*d*) of reduced diameter relative to the rest of the first part 1015*a* and which extends slightly through an aperture formed through an end of the housing 1002*a*. The second part 1015*b* (which is not shown in FIG. 11*d*) comprises a cylinder of smaller diameter than the first part 1015*a* and has an open end which fits over the projection 1015*d* and a closed end which forms the interface with the push rod 1003. A retaining clip (not shown) within the second part 1015*b* (or any other suitable retaining means) securely retains the second part 1015*b* on the projection 1015*d*.

The second body 1015 is supported within the housing 1002*a* by any suitable means, for example a retaining clip 1015*e*, so that it is rotatable about a longitudinal axis A-A of the capsule 1009 between the engine break off rotational position (FIG. 11*a*) and the engine break on rotational position (FIG. 11*b*).

An actuator 1016 is provided for moving the second body 1015 between these two rotational positions. In this example, the actuator 1016 comprises a sealed cylinder 1017 provided on a side of the rocker arm 1002 and containing a piston 1018 mounted for reciprocating movement within the cylinder 1017 between the engine break off position (FIG. 11*a*) in which the piston 1018 is fully retracted in the cylinder 1017 and the engine break on position (FIG. 11*b*) in which the piston 1018 is fully forward in the cylinder 1017. A return spring 1019 is arranged to bias the piston 1018 towards the engine break off position. A piston rod 1018*a* extends from a sealed end of the cylinder 1017 and carries at its end a pair of spaced apart planar push members 1020.

The first part 1015*a* of the second body 1015 comprises a lever 1015*c* extending transversely there from through an elongate slit 1021 formed through and running partially around a side surface of the housing 1002*a*. The lever 1015*c* terminates in a ball end 1015*d* which is between the planar push members 1020.

When the capsule 1009 and the actuator 1016 are in the engine break off position, the lever 1015*c* is at a first end of the slit 1021.

To actuate the engine break mode, the system 1010 activates a supply of hydraulic fluid, for example pressurised air, to move the piston from its retracted position (FIG. 11*a*) to its forward position (FIG. 11*b*). As the piston 1018 moves, the push member furthest to the right in FIGS. 11*a* and *b* pushes the lever 1015*c* from the first end of the slit 1021 to a second end of the slit 1021 causing the second body 1015 to rotate from the engine break off position (FIG. 11*a*) to the engine break on position (FIG. 11*b*).

When the engine break mode is subsequently de-actuated, the system de-activates the supply of hydraulic fluid and the return spring 1019 causes the piston 1018 to move from its forward position to its retracted position. As the piston 1018 moves, the push member furthest to the left in FIGS. 11*a* and *b* pushes the lever 1015*c* from the second end of the slit 1021 to the first end of the slit 1021 causing the second body 1015 to rotate from the engine break on position (FIG. 11*b*) to the engine break off position (FIG. 11*a*).

Figure 12B:
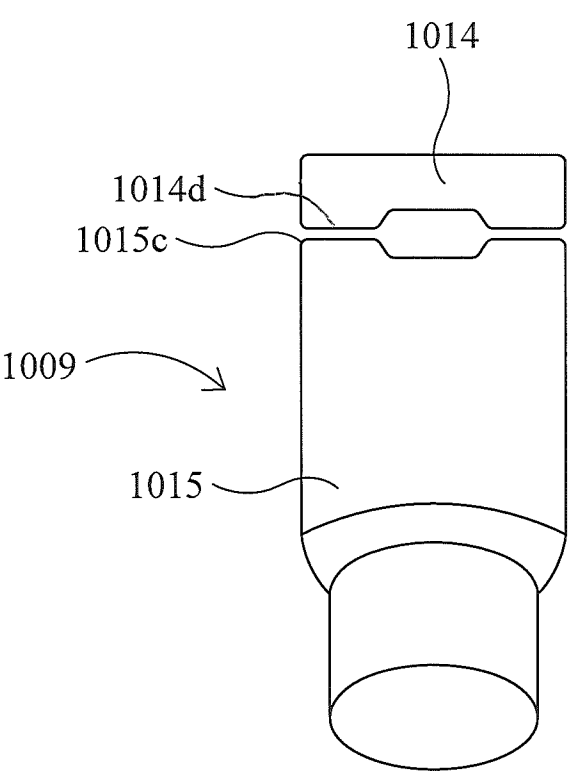
FIGS. 12*a* and 12*b* show schematic representation of the valve lifter according to the third embodiment.
Figure 12A:
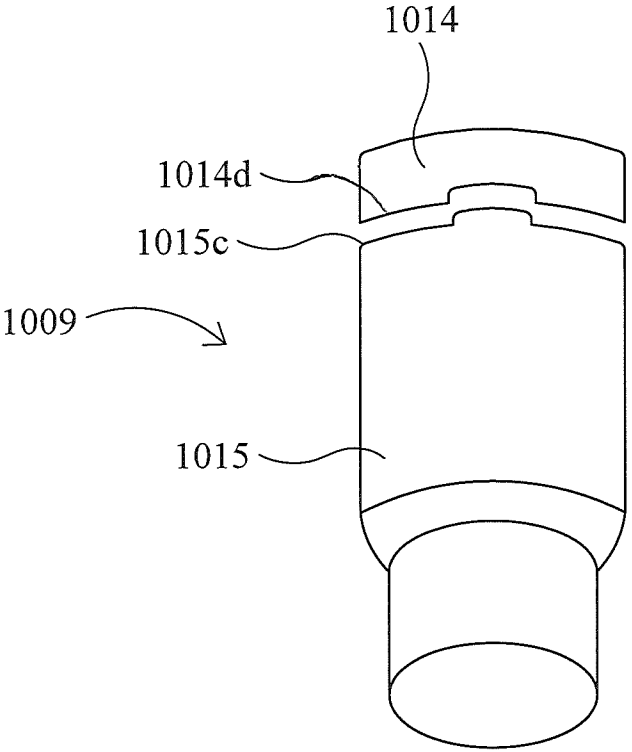
Figure 12C:
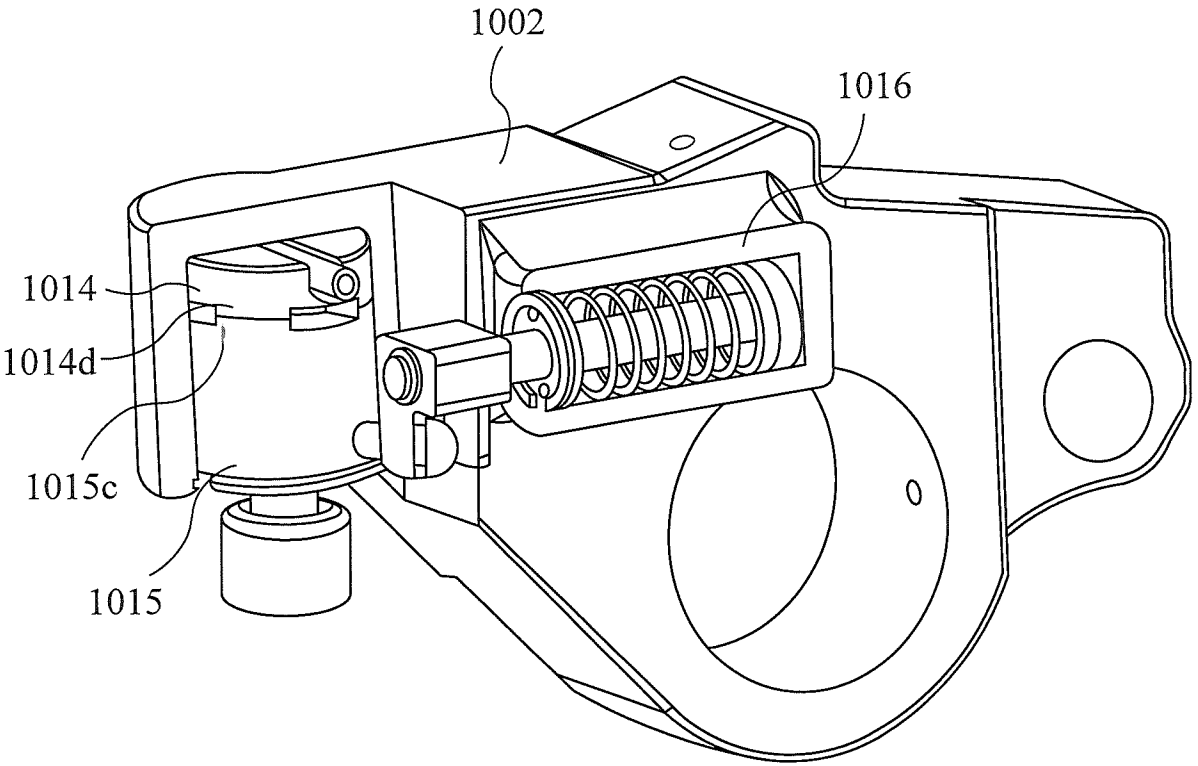
FIG. 12*c* shows a schematic representation of the valve lifter according to the third embodiment in relation to a rocker arm illustrated in partial cut away.

FIGS. 12*a* and 12*b* schematically illustrate the capsule 1009 in the engine break off position (FIG. 12*a*) and the engine break on position (FIG. 12*b*). FIG. 12*c* schematically illustrates the rocker arm 1002 in a partial cut away view with the capsule in the engine break on position. These figures, together with FIG. 11*d*, illustrate that the first body 1014 comprises a circular end portion 1014*d* and the second body 1015 comprises a corresponding circular end portion 1015*c* which end portions face each other. Both of the end portions 1014*d* and 1015*c* are crenulated around their lengths, each comprising a sequence of alternating raised parts and recesses. In the engine break off position, each raised part of the end portion 1014*d* faces a respective recess of the end portion 1015*c* and each recess of the end portion 1014*d* faces a respective raised part of the end portion 1015*c* and hence there is space between the two. In the engine break on position, each raised part of the end portion 1014*d* faces a respective raised part of the end portion 1015*c* and each recess of the end portion 1014*d* faces a respective recess of the end portion 1015*c*.

During engine operation, as the cam 1001 on the camshaft (not shown) rotates, the lobes 1012 and 1013 are presented in turn to the push rod 1003. In normal combustion mode, the capsule is in the engine break off configuration of FIG. 12*a*. As the lobe 1012 on the cam 1001 that corresponds to the breaking event rotates under the push rod 1003, it pushes the push rod 1003 upwards, which in turn pushes the second body 1015 upwards. The first body 1014 is fixed relative to the rocker arm 1002 and remains stationary as the second body 1015 moves upwards. As the second body 1015 moves upwards, each of the raised parts of the crenulated end portion 1015*c* moves into a respective facing recess of the crenulated end portion 1014*d* and each of the recesses of the crenulated end portion 1015*c* moves into a respective facing raised part of the crenulated end portion 1014*d*. The range of upward movement of the second body 1015 caused by the engine breaking lobe 1015 is however insufficient to bring the end portions 1014*d* and 1015*c* into contact with each other. The end portions remain separated by a small fraction at the highest point in the lift of the second body 1015 and therefore the upwards movement of the push rod does not cause the rocker arm 1002 to pivot to open the valve. As the lobe 1012 rotates over-centre, the push rod 1003 and the second body descend to their positions held prior to the onset of the lobe 1012. The capsule is provided in its interior with a lost motion spring 1015*f* (See FIG. 11*d*) which is compressed as the second body 1015 moves upwards and pushes the second body 1015 downwards once the lobe 1012 has rotated over centre.

As the lobe 1013, which corresponds to the normal combustion event, rotates under the push rod 1003, it causes the second body 1015 to rise further than does the lobe 1012 because it is a taller lobe. Accordingly, the second body 1015 initially moves upwards as is does when the engine-braking lobe 1012 is in action, but in this case, the second body 1015 continues to move upwards so that the crenulated end portion 1015*c* is brought into meshing contact with the crenulated end portion 1014*c*, the first 1014 and second 1015 bodies act as a single body and consequently the upwards movement of the push rod 1003 causes the rocker arm 1002 to pivot clockwise and the valve 1001 to open.

As the lobe 1013 rotates over-centre, the push rod 1003 and the second body 1015 descend, the valve 1001 closes under the action of the spring 1007 and the rocker arm 1002 pivots counter-clockwise.

When engine breaking mode is required, the control system 1010 activates the hydraulic fluid supply to move the piston from the retracted position to the forward position and in doing so to rotate the second body 1015 into the breaking mode on position. As the engine breaking lobe 1012 rotates under the push rod 1003, it pushes the push rod and hence the second body 1015 upwards. In the breaking mode on position, each raised part of the crenulated end portion 1014*d* faces a respective raised part of the crenulated end portion 1015*c* and hence there is little or no capacity for movement of the second body 1015 relative to the first body 1014 as the push rod rises. Instead, the first body 1014 and the second body 1015 act as a solid unit as the push rod 1003 rises, moving as one with the rocker arm 1002 under the action of the push rod 1003, as the rocker arm 1002 pivots clockwise forcing the valve 1001 to open.

As the lobe 1012 rotates over-centre, the valve closes under the action of the spring, the rocker arm pivots 1002 counter-clockwise and the push rod 1003 descends.

In the same way, the valve opens and closes as the lobe 1013 rotates under the push rod 1003, although because the lobe 1013 is taller, the valve opens further and for longer than when the lobe 1012 rotates under the push rod 1003.

Figure 13:
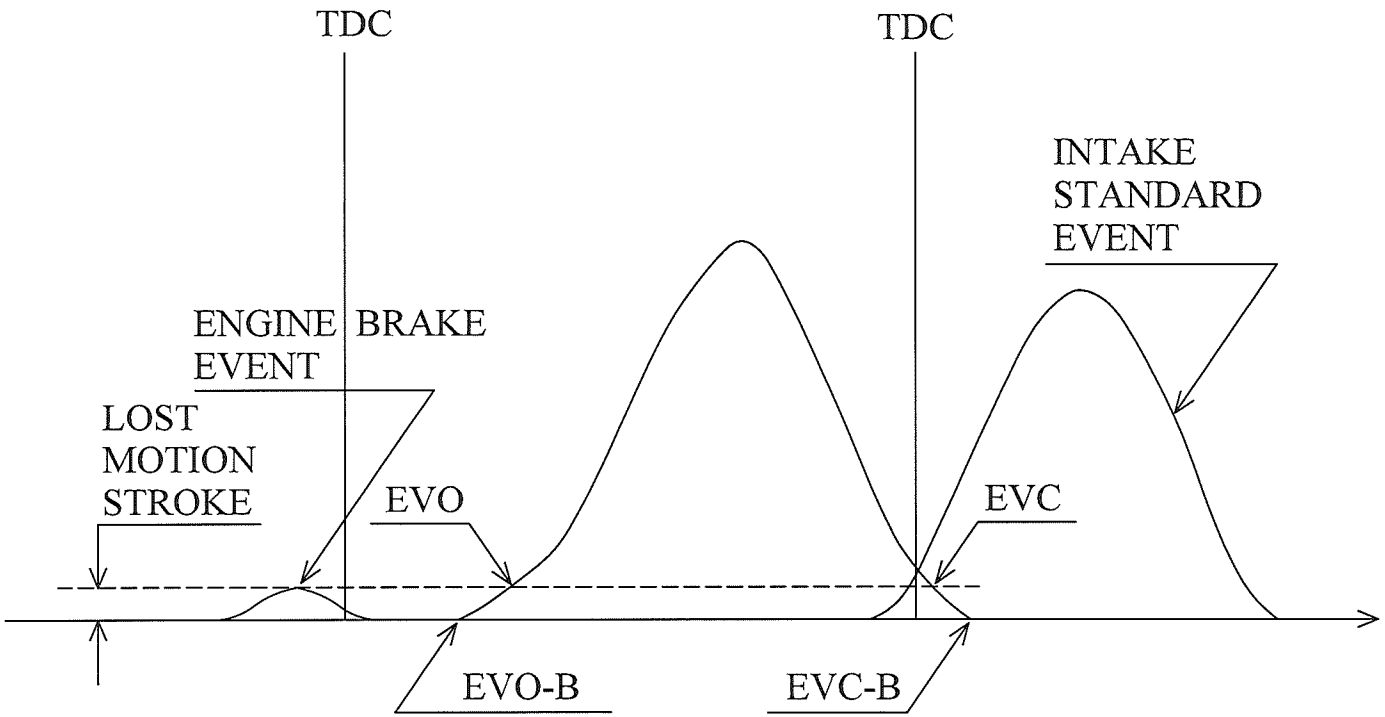
FIG. 13 schematically illustrates plots of valve lift against crank-shaft rotation.

FIG. 13 illustrates a graph of valve lift (Y-axis) against crank-shaft rotation (X-axis). It can be seen from the graph that in the normal combustion mode there is the one exhaust valve event per cycle caused by the lobe 1013 with the exhaust valve opening at the point EVO and closing at the point EVC. In the engine breaking mode there are two valve events in a cycle, the first caused by the lobe 1012 when the valve opens briefly just before Top Dead Center (TDC) to discharge compressed gas from the cylinder (the engine break event, with a lift of typically 1.6 mm) and a second caused by the lobe 1013 when the valve opens at the point EVO-B and closes at the point EVC-B (normal valve even, with a lift of typically 10 mm). The 'lost motion stroke' absorbed by the movement of the second body 1015 relative to the first body 1014 is illustrated as a broken line. For completeness, the graph also illustrates a valve event of a corresponding engine intake valve operating with the exhaust valve.

The shape of the end portions is such that the force transmitted through them (and through the capsule as whole) during a valve event is purely compressive. This is particularly advantageous if the valve event is a valve breaking even because the high chamber pressures involved result in a correspondingly high pressures being exerted on the capsule. Because the force being transmitted through the end portions is purely compressive the capsule is less likely to fail than if torque/shear forces were involved.

Figures 14A, 14B:
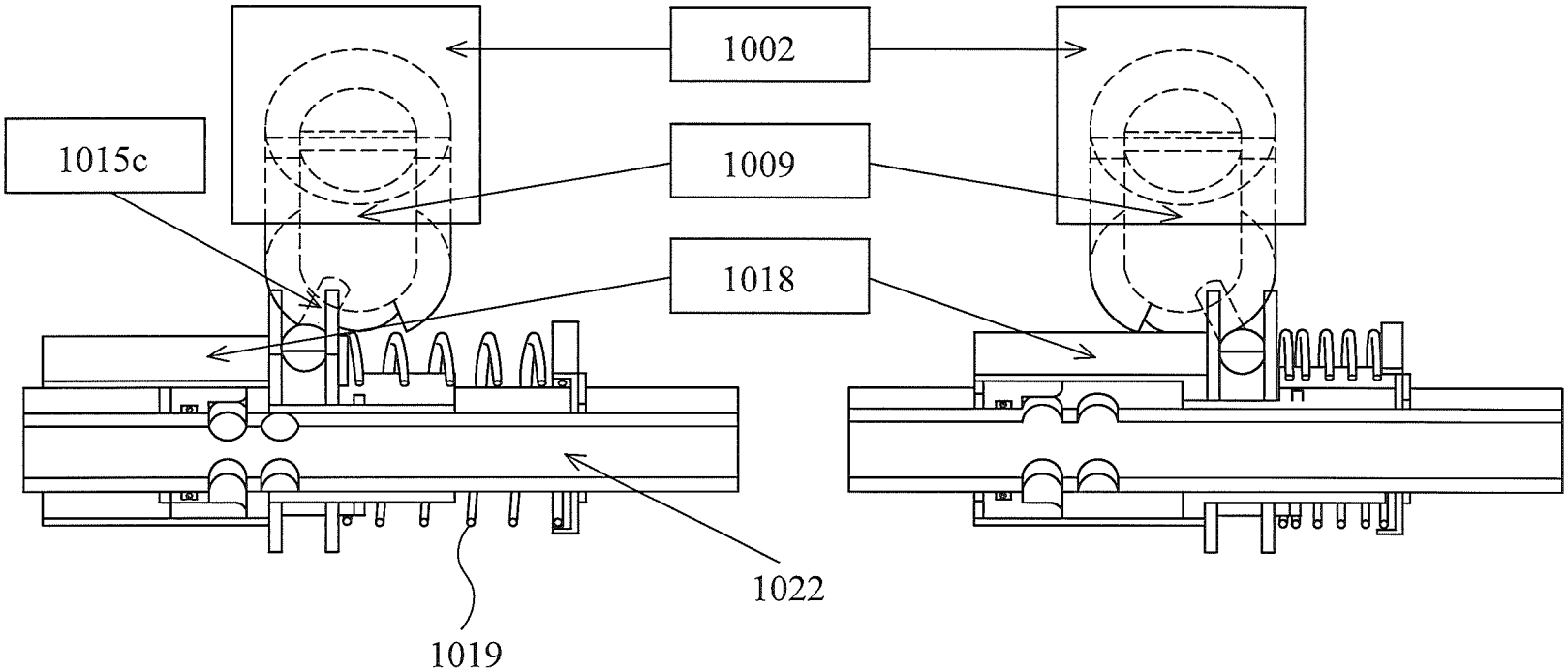
FIG. 14 schematically illustrates the valve lifter according to the third embodiment but with an alternative actuator arrangement.

FIGS. 14*a* (engine break off configuration) and 14*b* (engine break on configuration) illustrate an alternative embodiment in which the piston 1018 is not supported on the rocker arm 1002 but is instead mounted for reciprocal movement on an air supply shaft 1022 by means of which the control system 1010 supplies pressurised air to move the piston 1018 from the engine break off position to the engine break on position. A spring 1019 is again provided to move the piston 1018 back to the engine break off position when the control system deactivates the pressurised air supply.

Modifications

The skilled person will understand that the valve lifter 113 of the present invention, rather than acting through a push rod 111 and rocker arm 105 could also be used as a "direct" push device in which the connecting section 505 is attached directly to the engine valve 101.

The skilled person will understand that, for the valve lifter of the first or second embodiment, the transition between the latched and unlatched positions of the latch pins might only be made when the actuating cam is on a base circle portion, and the compressive force on the valve lifter is therefore at a minimum.

The skilled person will also understand that the opening and closing of the Oil Control Valve in both the first and second embodiments could be carried out automatically by a suitable control system so that the operation thereof could be automated.

The latch pins 217 of the first and second embodiments have been described as cylindrical. However, the skilled person will understand that the latch pins could be any shape or cross section provided that, when in the latched position, their upper surface sits beneath the inner body and is subject to purely compressive forces.

Although the second embodiment has been described in relation to an actuating cam having only a single lift portion, the skilled person will understand that the actuating cam could have a plurality of lift profiles (one of which might correspond to an engine compression braking valve opening event as described in the first embodiment). In this case, an engine control/management unit or the like, could control the actuation of the Oil Control Valve in order to move the latch pins between the latched and unlatched position so that one or more of the valve events corresponding to the plurality of lift profiles on the actuating cam could be selectively transmitted to the engine poppet valve.

For use in an engine requiring engine compression braking, the actuating cam could have a first "combustion" lift profile and a second, "engine braking" lift profile. When the engine is intended to operate in the normal combustion mode without engine braking, then the engine control unit would manipulate the Oil Control Valve (and hence the position of the latch pins to a latched position) so that the engine poppet valve is opened by the "combustion" lift profile. Once the "combustion" lift profile has passed and the cam is rotating a base circle portion against the cam follower, the engine control unit would manipulate the Oil Control Valve (and hence the position of the latch pins to the unlatched position) before the lift portion corresponding to the "engine braking" event occurs. Thus when the "engine braking" lift portion rotates against the cam follower, the engine poppet valve is not opened. Once the "engine braking" lift profile has passed and the cam is rotating a base circle portion against the cam follower again, the engine control unit would manipulate the Oil Control Valve again to move the position of the latch pins back to the latched position in readiness for the "combustion" lift profile again. The cycle would continue.

When the engine is intended to operate with engine braking, then the engine control unit would manipulate the Oil Control Valve (and hence the position of the latch pins to a latched position) and keep the latch pins in the latched position as both lift portions of the cam rotated against the cam follower. In this way the engine poppet valve would be opened by both the "combustion" lift profile, and the "engine braking" lift profile. The latch pins would be held in the latched position for as long as engine braking is required. When in "engine braking" mode, the opening force supplied to the engine poppet valve 905 from the engine-braking cam lobe, must not only be sufficient to overcome the returning force of the valve spring 919 but must also be sufficient to overcome the force exerted on the base of the engine poppet valve 905 by the high pressure air within the engine cylinder that has been compressed during the engine braking event which acts to keep the engine valve 905 in the closed position. Although when the valve lifter is rigid (i.e. the latch pins 217 are in the latched position), as it would be when in the "engine braking" mode of operation, the rocker arm 905 merely rotates about the top of the cylindrical plunger element 803, there is still an element of compressive force transmitted from the rocker arm down to the base of the valve lifter. This force is likely to be significant during an "engine-braking" mode of operation as in order to open the engine valve 905 the driving force must overcome not only the valve spring 919 but must also be sufficient to open the engine valve against the additional pressure of the compressed air charge in the cylinder.

The arrangement of the latch pins in the second embodiment allows the latch pins to channel the compressive force from the rocker arm 903 as purely compressive forces with no element of shear stress being applied to the latch pins 217 even though they are between the inner body 203 and outer body 201. Applying purely compressive forces to the latch pins results in a more robust arrangement, and hence the valve lifter is less likely to fail during an engine braking mode of operation.

The end portions 1014*a* and 1015*a* in the third embodiment are crenulated but it will be appreciated that that each end portion may have other shapes, in particular but not exclusively, other shapes consisting of one or more raised sections and one or more recesses.

In the third embodiment, the second body 1015 is rotated relative to the first body 1014 to change the configuration of the capsule form the engine break on configuration to the engine break off configuration and vice versa. It will be appreciated that in other embodiments relative movement other than rotation may be used to achieve this, for example relative transverse movement.

Embodiments of the invention have been described in detail in the foregoing description, and it is believed that various alterations and modifications will become apparent to those skilled in the art from a reading and understanding of the specification. It is intended that all such alterations and modifications are included in the invention, insofar as they come within the scope of the appended claims.

What is claimed is:

1. A valve control device for an internal combustion engine with an engine valve and a camshaft having a cam profile including a first lift profile and a second lift profile, the valve control device comprising:

a first body having an end portion that includes first one or more raised sections and first one or more recesses; and a second body having an end portion that includes second one or more raised sections and second one or more recesses;

wherein the valve control device is configurable in a first configuration and a second configuration;

when the valve control device is in the first configuration, the second one or more recesses respectively face the first one or more raised sections, thereby enabling relative movement between the first body and the second body, caused when said first lift profile engages a cam engagement surface, to inhibit a valve actuating linkage from actuating said engine valve, and when said second lift profile engages the cam engagement surface, the valve control device allows initial relative movement between the first body and the second body before the end portions are brought into contact to prevent subsequent relative movement and enable the valve actuating linkage to actuate said engine valve;

when the valve control device is in the second configuration, the second one or more raised sections respectively face the first one or more raised sections, thereby preventing relative movement between the first body and the second body, caused when the first lift profile engages the cam engagement surface, to enable the valve actuating linkage to actuate said engine valve; and the respective end portions of the first body and the second body are arranged such that substantially all of the force exerted thereon as the valve is actuated is compressive.

2. The valve control device of claim 1, wherein the valve control device is operable between the first configuration and the second configuration by moving the second body between a first position and a second position.

3. The valve control device of claim 1, wherein the valve control device is operable between the first configuration and the second configuration by rotating the second body between a first position and a second position.

4. The valve control device of claim 1, wherein the second lift profile of the cam profile is taller than the first lift profile.

5. The valve control device of claim 4, wherein, when the valve control device is in the second configuration and the second lift profile engages the cam engagement surface, the end portions of the first body and the second body prevent relative movement between the first and second bodies, thereby enabling the valve actuating linkage to actuate said engine valve.

6. The valve control device of claim 1, wherein the valve actuating linkage includes a rocker arm and the valve control device is supported on a first end of the rocker arm.

7. The valve control device of claim 6, wherein the rocker arm includes a housing on the first end thereof, and the valve control device is supported within the housing.

8. The valve control device of claim 7, wherein the first body is fixedly supported within the housing by a support rod that extends through the housing, and the second body is supported for rotation within the housing by a retaining clip.

9. The valve control device of claim 6, wherein the valve actuating linkage further includes a push rod having first and seconds ends, and the cam profile acts upon the first end of the push rod, the second end of the push rod acts upon the valve control device located at the first end of the rocker arm, and a second end of the rocker arm acts upon said engine valve.

10. The valve control device of claim 1, wherein said first lift portion of the cam profile defines an engine breaking mode profile for providing an engine-breaking valve lift event.

11. The valve control device of claim 1, wherein said second lift portion of the cam profile defines a normal engine combustion mode profile providing a combustion valve lift event.

12. The valve control device of claim 2, including an actuator for moving the second body between the first position and the second position.

13. The valve control device of claim 12, wherein the actuator includes a piston that is configured to move the second body between the first position and the second position.

14. The valve control device of claim 13, including a lever that extends transversely from the second body, and the piston is configured to move the lever.

15. The valve control device of claim 13, including a valve for supplying pressurized fluid from a fluid source to the piston to move the second body from the first position to the second position.

16. The valve control device of claim 15, wherein the actuator is one of a hydraulic actuator and a pneumatic actuator.

17. The valve control device of claim 2, including a return spring that is configured to bias the second body in the first position.

18. The valve control device of claim 1, including a lost motion spring which is compressed during relative movement between the first body and the second body.

19. The valve control device of claim 18, wherein the first body and the second body are cylindrical members that define open ends which face one another, and the lost motion spring is disposed within the open ends between the first body and the second body.

20. The valve control device of claim 1, wherein the end portions of the first body and the second body each include alternating raised sections and recesses.

* * * * *